US008746830B2

(12) United States Patent
Chiwata

(10) Patent No.: US 8,746,830 B2
(45) Date of Patent: Jun. 10, 2014

(54) IMAGE FORMING APPARATUS AND IMAGE FORMING METHOD

(75) Inventor: Yuhei Chiwata, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 87 days.

(21) Appl. No.: 13/559,619
(22) Filed: Jul. 27, 2012
(65) Prior Publication Data

US 2013/0044170 A1 Feb. 21, 2013

(30) Foreign Application Priority Data

Aug. 19, 2011 (JP) ..... 2011-179953
Jul. 5, 2012 (JP) ..... 2012-151632

(51) Int. Cl.

| | |
|---|---|
| ***B41J 2/01*** | (2006.01) |
| ***B41J 29/38*** | (2006.01) |
| ***B41J 11/42*** | (2006.01) |
| ***B41J 11/00*** | (2006.01) |
| *B41J 13/08* | (2006.01) |

(52) U.S. Cl.
CPC ..... *B41J 11/42* (2013.01); *B41J 11/007* (2013.01); *B41J 13/08* (2013.01); *B41J 11/002* (2013.01)
USPC ..... 347/15; 347/16; 347/104; 347/102

(58) Field of Classification Search
USPC ..... 347/16, 104, 102, 101; 101/488; 219/216; 346/25
See application file for complete search history.

(56) References Cited

U.S. PATENT DOCUMENTS

| | | | | |
|---|---|---|---|---|
| 3,013,487 | A * | 12/1961 | Faeber | 101/181 |
| 3,032,245 | A * | 5/1962 | George et al. | 226/39 |
| 3,463,414 | A * | 8/1969 | De Hertel Eastcott | 242/421.1 |
| 4,506,457 | A * | 3/1985 | Lehtinen | 34/393 |

(Continued)

FOREIGN PATENT DOCUMENTS

| | | | |
|---|---|---|---|
| JP | 4-338575 | A | 11/1992 |
| JP | 05031893 | A * | 2/1993 |
| JP | 2005-112577 | | 4/2005 |
| JP | 2009-220411 | | 10/2009 |
| JP | 2010-13258 | | 1/2010 |
| JP | 2010-064858 | | 3/2010 |

OTHER PUBLICATIONS

English language translation of the following: Office Action dated Oct. 22, 2013 from the JPO in a Japanese patent application corresponding to the instant patent application. This Office action translation is submitted now in order to supplement the understanding of patent document JP2010-13258 which is cited in the office action and is being disclosed in the instant information Disclosure Statement.

English language translation of the following: Office action dated, Jul. 30, 2013 from th JPO in a Japanese patent application corresponding to the instant patent application. This office action is submitted now in order to supplement the understanding of patent document JP2009-220411, JP2005-112577 and JP2010-64858 which are cited in the office action and are bring disclosed in the instant Information Disclosure Statement.

*Primary Examiner* — Laura Martin
*Assistant Examiner* — Leonard S Liang
(74) *Attorney, Agent, or Firm* — SOLARIS Intellectual Property Group, PLLC

(57) ABSTRACT

The image forming apparatus of the present invention includes an image forming member that jets liquid droplets onto a recording medium and forms an image on a front face of the recording medium, a tension imparting member that induces tension of 100 N/m to 1000 N/m in the recording medium image-formed on the recording medium front face by the image forming member, and a drying member that dries the image formed on the front face of the recording medium when tension induced in the recording medium by the tension imparting member to a residual moisture level of 3 g/m$^2$ or less in the recording medium.

13 Claims, 15 Drawing Sheets

(56) References Cited

U.S. PATENT DOCUMENTS

| | | | | |
|---|---|---|---|---|
| 6,092,891 | A * | 7/2000 | Okubo et al. | 347/104 |
| 6,254,090 | B1 * | 7/2001 | Rhodes et al. | 271/276 |
| 6,601,951 | B2 * | 8/2003 | Kuwabara et al. | 347/101 |
| 6,913,354 | B2 * | 7/2005 | Rasmussen et al. | 347/102 |
| 8,056,893 | B2 * | 11/2011 | Mandel et al. | 271/3.21 |
| 2005/0024461 | A1 * | 2/2005 | Ishii et al. | 347/104 |
| 2007/0126832 | A1 * | 6/2007 | Kito | 347/101 |
| 2009/0231407 | A1 | 9/2009 | Kachi | |
| 2009/0295894 | A1 * | 12/2009 | Hori | 347/102 |
| 2011/0025807 | A1 * | 2/2011 | Fukui | 347/104 |

* cited by examiner

FIG.8

GRAPHIC PRECISION EVALUATION RESULTS

| N/m | |
|---|---|
| 0 | A |
| 250 | A |
| 500 | A |
| 750 | B |
| 1000 | C |
| 1250 | D |
| 1500 | D |

IMAGE FORMING APPARATUS AND IMAGE FORMING METHOD

CROSS-REFERENCE TO RELATED APPLICATIONS

This application claims priority under 35 USC 119 from Japanese Patent Application No. 2011-179953 filed on Aug. 19, 2011, and Japanese Patent Application No. 2012-151632 filed on Jul. 5, 2012, the disclosures of which are incorporated by reference herein.

BACKGROUND

1. Technical Field

The present invention relates to an image forming apparatus and an image forming method for forming an image on a recording medium.

2. Related Art

An inkjet recording apparatus (image forming apparatus) is described in Japanese Patent Application Laid-Open (JP-A) No. 04-338575 in which, during a heating and drying process directly after forming an image on a recorded-on member (a recording medium), tension towards the paper discharge direction is applied to the recorded-on member to maintain the straight form of the recorded-on member.

However, the tension applied to the recording medium is not specified in the conventional configuration, and the degree of drying of the recording medium in the heating and drying process is also not specified. It is therefore a configuration that sometimes cannot suppress waviness from occurring in the recording medium.

SUMMARY

The present invention provides an image forming apparatus and image forming method for suppressing waviness from occurring in a recording medium.

An image forming apparatus of a first aspect of the present invention includes: an image forming member that jets liquid droplets onto a recording medium and forms an image on a front face of the recording medium; a tension imparting member that induces tension of 100 N/m to 1000 N/m in the recording medium image-formed on the recording medium front face by the image forming member; and a drying member that dries the image formed on the front face of the recording medium, when tension induced in the recording medium by the tension imparting member, to a residual moisture level of 3 g/m$^2$ or less in the recording medium.

According to the above configuration, the tension imparting member induces tension of 100 N/m to 1000 N/m in the recording medium. Furthermore, the drying member dries the image formed on the front face of the recording medium, when tension induced in the recording medium by the tension imparting member, to a residual moisture level of 3 g/m$^2$ or less in the recording medium. Waviness can accordingly be suppressed from occurring in the recording medium.

An image forming apparatus of a second aspect of the present invention is the first aspect of the present invention configured such that the tension imparting member induces tension along the recording medium conveying direction.

According to the above configuration, waviness can be efficiently suppressed from occurring in the recording medium in cases in which the machine direction of the recording medium for image forming faces a direction orthogonal to the recording medium conveying direction.

An image forming apparatus of a third aspect of the present invention is the second aspect of the present invention configured such that the tension imparting member includes a conveying member that retains with a retaining member a leading end portion of the recording medium image-formed by the image forming member and conveys the recording medium, and a suction-attachment plate for suction-attaching the back face of the recording medium being conveyed by the conveying member while the leading end portion of the recording medium is retained by the retaining member.

According to the above configuration the recording medium is conveyed by the conveying member with the leading end portion of the recording medium, whose back face is suction-attached to the suction-attachment plate, retained by the retaining member. Tension can thereby be induced in the recording medium in the recording medium conveying direction.

An image forming apparatus of a fourth aspect of the present invention is the third aspect of the present invention configured to further include a moving member that moves the suction-attachment plate towards the recording medium conveying direction downstream side while the recording medium being conveyed by the conveying member is in a suction-attached state. Tension is induced in the recording medium by the movement speed of the suction-attachment plate due to the moving member being slower than the movement speed of the recording medium due to the conveying member According to the above configuration damage to the back face of the recording medium can be suppressed since the suction-attachment plate to which the back face of the conveyed recording medium is suction-attached is moved by the moving member towards the recording medium conveying direction downstream side.

An image forming apparatus of a fifth aspect of the present invention is the first aspect of the present invention configured such that the tension imparting member induces tension in the recording medium in a direction orthogonal to the recording medium conveying direction.

According to the above configuration waviness can be efficiently suppressed from occurring in the recording medium in cases in which the machine direction of the recording medium for image forming faces in the recording medium conveying direction.

An image forming apparatus of a sixth aspect of the present invention is the fifth aspect of the present invention configured such that the tension imparting member includes: a first conveyor belt that circulates with the back face of the recording medium suction-attached to the first conveyor belt so as to convey the recording medium; and a second conveyor belt disposed alongside the first conveyor belt, circulating with the back face of the recording medium suction-attached to the second conveyor belt so as to convey the recording medium, and disposed so as to be separated further from the first conveyor belt at the recording medium conveying direction downstream side than at the conveying direction upstream side.

According to the above configuration, the recording medium is conveyed with the back face of the recording medium suction-attached to the circulating first conveyor belt and the circulating second conveyor belt. The second conveyor belt is disposed so as to separate further from the first conveyor belt on progression towards the recording medium conveying direction downstream side. Tension can accordingly be induced between the first conveyor belt and the second conveyor belt in a direction orthogonal to the recording medium conveying direction.

An image forming apparatus of a seventh aspect of the present invention is the first aspect of the present invention configured to further include a controller that controls the tension imparting member based on the direction of the machine direction of the recording medium so as to select to induce tension in the recording medium in the recording medium conveying direction or to induce tension in the recording medium in a direction orthogonal to the recording medium conveying direction.

According to the above configuration, the controller controls the tension imparting member based on the direction of the machine direction of the recording medium so as to select to induce tension in the recording medium in the recording medium conveying direction or to induce tension in the recording medium in a direction orthogonal to the recording medium conveying direction. Waviness can accordingly be efficiently suppressed from occurring in the recording medium.

An image forming apparatus of an eighth aspect of the present invention is the first aspect of the present invention configured such that the recording medium is sheet-paper and the tension imparting member induces tension in the sheet-paper.

According to the above configuration, waviness can be suppressed from occurring in the sheet-paper by the tension imparting member inducing tension in the sheet-paper.

An image forming apparatus of a ninth aspect of the present invention is the first aspect of the present invention configured such that the recording medium is continuous-paper and the tension imparting member induces tension in the continuous-paper.

According to the above configuration, waviness can be suppressed from occurring in the continuous-paper by the tension imparting member inducing tension in the continuous-paper.

An image forming apparatus of a tenth aspect of the present invention is the first aspect of the present invention configured to further include a process liquid coating member provided at the recording medium conveying direction upstream side of the image forming member for coating the recording medium with a process liquid that aggregates colorant present in the liquid droplets jetted from the image forming member.

According to the above configuration, liquid droplets (ink) can be suppressed from penetrating into the recording medium due to the process liquid coating member coating the recording medium with the aggregating process liquid that causes colorant in the liquid droplets to aggregate. Waviness can accordingly be efficiently suppressed from occurring in the recording medium.

An image forming apparatus of an eleventh aspect of the present invention is the tenth aspect of the present invention configured to further include a process liquid drying member that dries the process liquid that was coated on the recording medium by the process liquid coating member.

According to the above configuration, the process liquid drying member dries the process liquid that was coated on the recording medium by the process liquid coating member. Softening of the recording medium can be reduced due to such drying of a moisture component arising from the process liquid, and waviness can accordingly be efficiently suppressed from occurring in the recording medium.

An image forming method of a twelfth aspect of the present invention includes: an image forming process of jetting liquid droplets onto a recording medium and forming an image on a front face of the recording medium; and a liquid droplet drying process of drying the image formed on the front face of the recording medium induced with tension of 100 N/m to 1000 N/m to a residual moisture level of 3 g/m$^2$ or less in the recording medium when the tension induced in the recording medium.

According to the above configuration, in the liquid droplet drying process the image formed on the recording medium induced with tension of 100 N/m to 1000 N/m is dried to a residual moisture level of 3 g/m$^2$ or less in the recording medium when the tension induced in the recording medium. Waviness can thereby be suppressed from occurring in the recording medium.

An image forming method of a thirteenth aspect of the present invention is the twelfth aspect of the present invention configured to further include a process liquid coating process provided prior to the image forming process for coating the recording medium with a process liquid that aggregates colorant present in the liquid droplets jetted onto the recording medium in the image forming process.

According to the above configuration, liquid droplets (ink) can be suppressed from penetrating into the recording medium due to coating the recording medium with the process liquid that causes colorant in the liquid droplets to aggregate in the process liquid coating process. Waviness can accordingly be efficiently suppressed from occurring in the recording medium.

An image forming method of a fourteenth aspect of the present invention is the thirteenth aspect of the present invention configured to further include a process liquid drying process that dries the process liquid coated onto the recording medium in the process liquid coating process.

According to the above configuration, the process liquid coated onto the recording medium in the process liquid coating process is dried by the process liquid drying process. Softening of the recording medium can be reduced due to such drying of a moisture component arising from the process liquid, and waviness can accordingly be efficiently suppressed from occurring in the recording medium.

BRIEF DESCRIPTION OF THE DRAWINGS

Exemplary embodiments of the present invention will be described in detail based on the following figures, wherein:

FIG. 8 is a table illustrating evaluation results of evaluation of graphic precision related to an image forming apparatus according to the first exemplary embodiment of the present invention;

DETAILED DESCRIPTION

Figure 1:
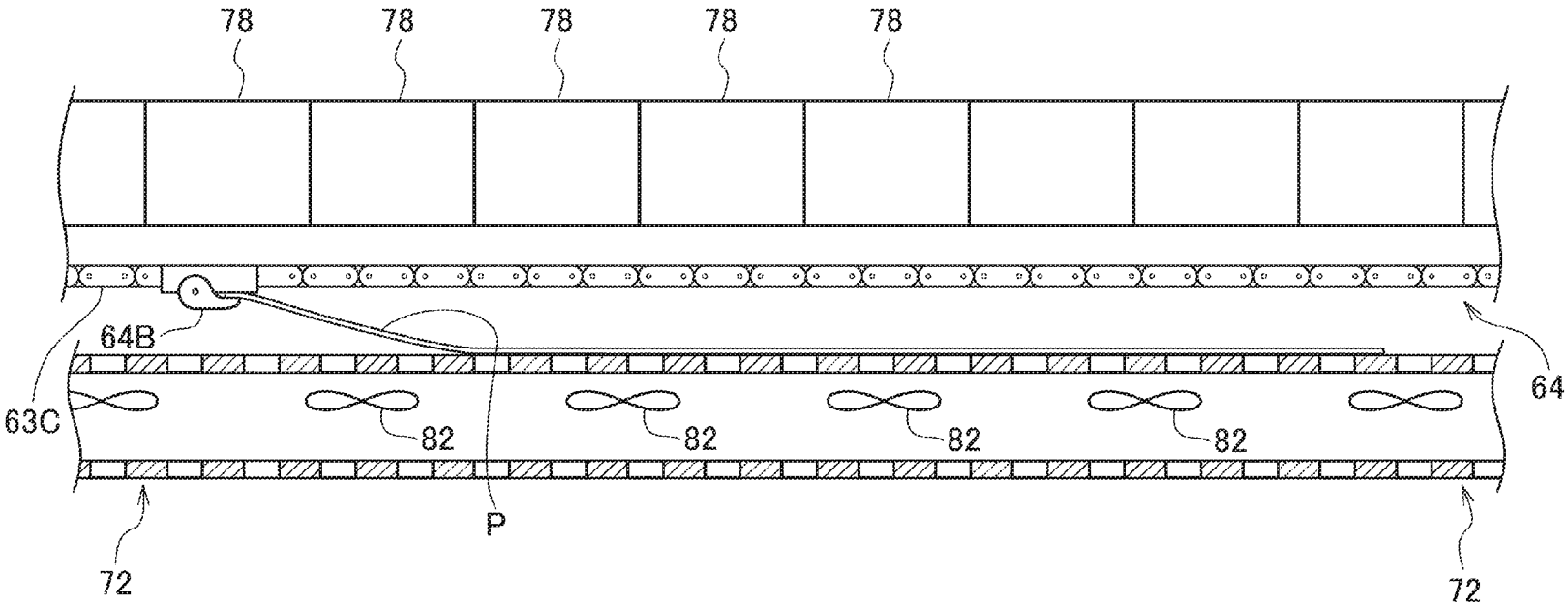
FIG. 1 is a side view illustrating a suction-attachment plate and a chain gripper employed in an image forming apparatus according to a first exemplary embodiment of the present invention.

Explanation follows regarding an example of an image forming apparatus 10 according to a first exemplary embodiment of the present invention, with reference to FIG. 1 to FIG. 8. In the drawings the arrow UP indicates the vertically upwards direction.

Overall Configuration

Figure 4:
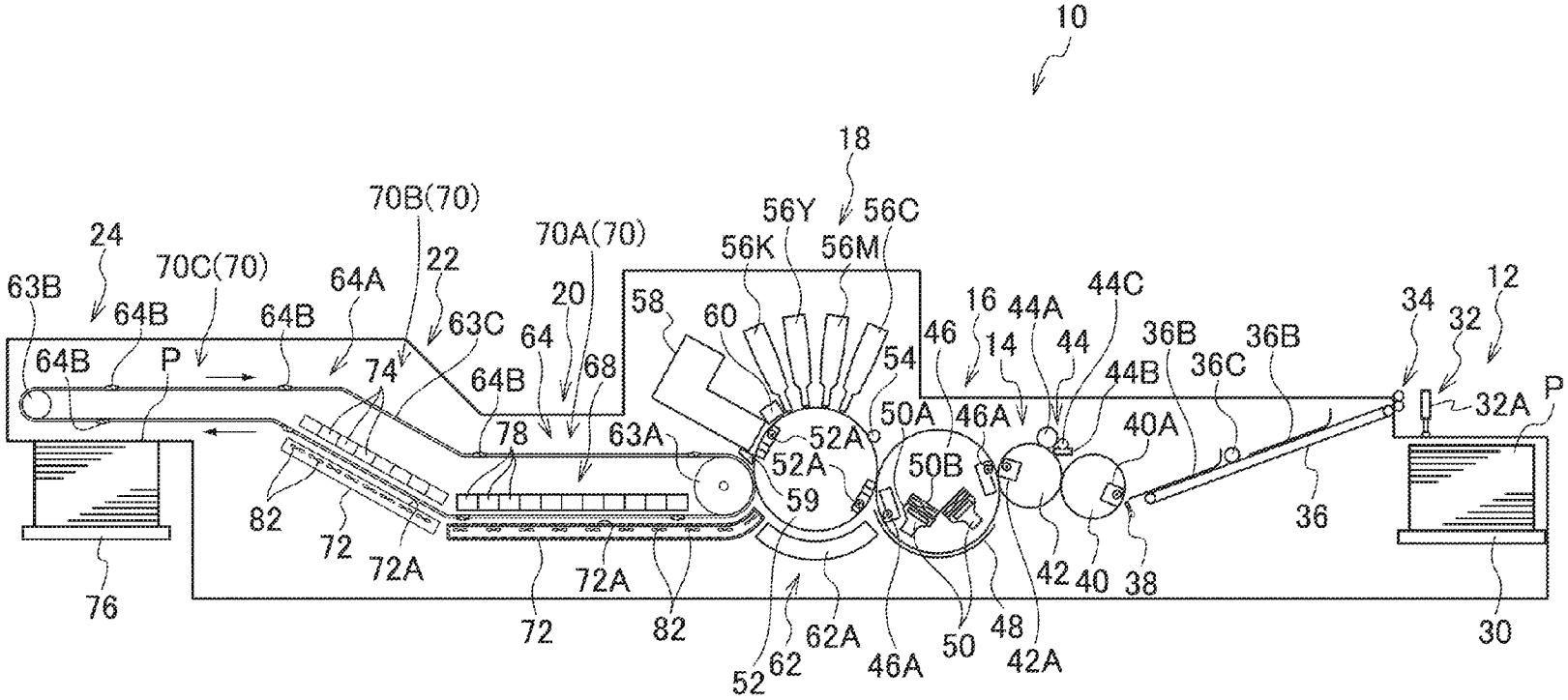
FIG. 4 is a schematic configuration diagram illustrating an image forming apparatus according to the first exemplary embodiment of the present invention.

As shown in FIG. 4, the image forming apparatus 10 according to the present exemplary embodiment is an apparatus for forming an image on a sheet member P serving as a recording medium by an inkjet method using water-based UV inks (inks that use an aqueous medium and are cured with ultraviolet (UV) radiation). The image forming apparatus 10 is configured so as to mainly include: a paper feeder 12 for feeding each of the sheet members P; a process liquid application section 14 for applying a specific process liquid onto the front face (image recording face) of the sheet member P fed in from the paper feeder 12; a process liquid drying section 16 for drying the sheet member P to which the process liquid has been applied by the process liquid application section 14; an image recording section 18 for forming an image on the front face of the sheet member P dried by the process liquid drying section 16; an ink drying section 20 for drying the sheet member P formed with an image by the image recording section 18; a UV irradiation section 22 for performing UV irradiation (fixing processing) to the sheet member P dried by the ink drying section 20 so as to fix the image onto the sheet member P; and a paper discharge section 24 for discharging the sheet member P that has been irradiated with UV by the UV irradiation section 22.

Paper Feeder

The paper feeder 12 is configured so as to mainly include: a paper feed plate 30 on which the sheet members P are stacked; a sucker device 32 that feeds out each of the sheet members P; paper feed rollers 34 that convey the fed sheet member P; a conveyor belt 36 that conveys the sheet member P; a front stop 38 that aligns the leading end portion of the sheet member P; and a paper feed drum 40 that conveys the sheet member P while rotating.

The paper feed plate 30 is equipped with a paper feed plate raising and lowering device (not shown in the drawings) for raising and lowering the paper feed plate 30 such that the uppermost sheet member P stacked on the paper feed plate 30 is at a constant height.

The sucker device 32 is equipped with suction feet 32A provided so as to be capable of raising, lowering and swinging. The top face of the sheet member P is suction-attached and retained by the suction feet 32A, such that the sheet member P is thereby fed out from the paper feed plate 30 to the paper feed rollers 34.

Specifically the suction feet 32A suction-attach and retain the top face of the leading edge side of the uppermost sheet member P stacked on the paper feed plate 30, pick up the sheet member P, and feed the leading edge of the picked-up sheet member P out towards the paper feed rollers 34.

The conveyor belt 36 is disposed so as to slope downwards on progression along the sheet member conveying direction towards the downstream side (referred to below simply as the conveying direction downstream side). The sheet member P mounted on the conveying face of the conveyor belt 36 is then guided along the conveying face to front stops 38.

Plural individual plate shaped retainers 36B are fixed above the conveying face of the conveyor belt 36 to suppress lifting up and undulations in the sheet member P being conveyed by the conveyor belt 36. The retainers 36B are disposed along the sheet member P conveying direction alongside each other in the sheet member P width direction (a direction orthogonal to the conveying direction along which the sheet member P is conveyed).

A roller 36C for pressing the conveyed sheet member P onto the conveying face of the conveyor belt 36 is provided between one of the retainers 36B and another of the retainers 36B aligned along the sheet member P conveying direction.

Plural of the front stops 38 are provided individually along the sheet member P width direction (referred to below simply as the sheet member width direction). The front stops 38 are provided such that leading edge portions of the sheet member P make contact with (are pressed against) the front stops 38 disposed in a row along the sheet member width direction, thereby correcting the orientation (skew) of the sheet member P.

The front stops 38 are also provided with pivoting devices (not shown in the drawings) to pivot the front stops 38 so as to pass the skew-corrected sheet member P across to the rotating paper feed drum 40.

The paper feed drum 40 is formed in a circular cylindrical shape and is provided with a drive source (not shown in the drawings) for rotating the paper feed drum 40. Grippers 40A are also provided on the outer peripheral face of the paper feed drum 40 for retaining leading edge portions of the conveyed sheet member P.

The thus configured paper feed drum 40 thereby conveys each of the sheet members P towards the process liquid application section 14 by rotating with the leading edge portions of the sheet member P retained by the grippers 40A and the sheet member P wrapped onto the peripheral face of the paper feed drum 40.

Process Liquid Application Section

The process liquid application section 14 is configured so as to mainly include: a process liquid application drum 42 for conveying the sheet member P, and a process liquid application unit 44, serving as an example of a process liquid application member, for applying to the front face of the sheet member P being conveyed by the process liquid application drum 42 a process liquid that aggregates colorant (pigment particles) in liquid droplets (ink).

The process liquid application drum 42 is formed in a circular cylindrical shape and is provided with a drive source (not shown in the drawings) for rotating the process liquid application drum 42. Grippers 42A are also provided on the outer peripheral face of the process liquid application drum 42 for retaining the leading edge portions of the conveyed sheet member P.

The thus configured process liquid application drum 42 thereby conveys each of the sheet members P towards the process liquid drying section 16 by rotating, with the leading edge portions of the sheet member P that has been passed across from the paper feed drum 40 retained by the grippers 42A and with the sheet member P wrapped around the peripheral face of the process liquid application drum 42.

The process liquid application unit 44 is configured so as to mainly include: an application roller 44A for applying process liquid to the sheet member P; a process liquid tank 44B in which process liquid is stored; and a pickup roller 44C for picking up process liquid stored in the process liquid tank 44B and feeding it to the application roller 44A. The thus configured process liquid application unit 44 thereby applies the process liquid by roller to the front face of the sheet member P being conveyed by the process liquid application drum 42.

The process liquid contains an aggregating agent for aggregating components in ink compositions.

The aggregating agent may be a compound capable of changing the pH of ink compositions, may be a multivalent metal salt, or may be a polyallylamine compound. A compound capable of changing the pH of ink compositions is preferably employed in the present exemplary embodiment from the perspective of ability to aggregate ink compositions, and a compound that lowers the pH of ink compositions is more preferably employed. Examples of compounds suitably employed as a compound that lowers the pH of ink compositions are highly water soluble acidic substances (such as phosphoric acid, oxalic acid, malonic acid, citric acid, or derivatives or salts of such compounds).

Thus a highly water soluble acidic substance is preferable as the aggregating agent, and an organic acid is preferable from the perspectives of raising the aggregating ability and solidifying ink as a whole, and an organic acid of divalent or higher-valent is more preferable. An acidic substance of divalent or trivalent is particularly preferable. An organic acid with a first pKa of 3.5 or less is preferably among such organic acids of divalent or higher-valent, with an organic acid with first pKa of 3.0 or less being more preferable. Specific preferable examples thereof include phosphoric acid, oxalic acid, malonic acid and citric acid.

A single type of acidic substance alone may be employed as the aggregating agent, or two or more types may be employed in combination as the aggregating agent. The aggregating ability can thereby be raised and the ink can be solidified as a whole. The amount of aggregating agent contained in the process liquid for aggregating ink compositions is preferably set in the range of 1 to 50 percent by weight, more preferably in the range of 3 to 45 percent by weight, and even more preferably in the range of 5 to 40 percent by weight. The pH (25° C.) of ink compositions is preferably 8.0 or higher, and the pH (25° C.) of the process liquid is preferably in the range of 0.5 to 4. Image density and resolution can thereby be achieved together with a fast speed of inkjet recording.

The process liquid may contain other additives. Examples of known additives that may be employed therefor include drying inhibitors (wetting agents), anti-fading agents, emulsification stabilizers, penetration promoters, ultraviolet absorbers, preservatives, fungicides, pH adjusting agents, surface tension adjusting agents, anti-foaming agents, viscosity adjusting agents, dispersants, dispersion stabilizers, anti-rust agents and chelating agents.

Process Liquid Drying Section

The process liquid drying section 16 is configured so as to mainly include: a process liquid drying drum 46 for conveying the sheet member P; a conveying guide 48 that curves around the outer peripheral face of the process liquid drying drum 46; and process liquid drying units 50 serving as examples of process liquid drying members for drying the process liquid by blowing hot air onto the front face of the sheet member P being conveyed by the process liquid drying drum 46.

The process liquid drying drum 46 is formed in a circular cylindrical shape and is provided with a drive source (not shown in the drawings) for rotating the process liquid drying drum 46. Grippers 46A are also provided on the outer peripheral face of the process liquid drying drum 46 for retaining leading edge portions of the conveyed sheet member P.

The thus configured process liquid drying drum 46 thereby conveys each of the sheet members P towards the image recording section 18 by rotating, with leading edge portions of the sheet member P that has been passed across from the process liquid application drum 42 retained by the grippers 46A and with the sheet member P wrapped around the peripheral face of the process liquid drying drum 46.

There are two of the individual process liquid drying units 50 provided inside the process liquid drying drum 46, each internally equipped with a heater 50A, and a fan 50B for blowing air that has been warmed by the heater 50A against the front face of the sheet member P.

Image Recording Section

The image recording section 18 is configured so as to mainly include: an image recording drum 52 for conveying each of the sheet members P; a press roller 54 for pressing the sheet member P conveyed by the image recording drum 52 so as to place the sheet member P in close contact with the peripheral face of the image recording drum 52; recording heads 56C, 56M, 56Y, 56K serving as examples of an image recording member for jetting liquid droplets (ink droplets) of colors C, M, Y, K, respectively, onto the sheet member P; an inline sensor 58 for reading image data formed on the sheet member P; a mist filter 60 for trapping ink mist; and a drum cooling unit 62 for cooling the image recording drum 52. The suffixes Y, M, C, K are omitted in the following explanation when there is no need to discriminate between Y, M, C, K.

The image recording drum 52 is formed in a circular cylindrical shape and is provided with a drive source (not shown in the drawings) for rotating the image recording drum 52. Grippers 52A are also provided on the outer peripheral face of the image recording drum 52 for retaining leading edge portions of the conveyed sheet member P.

The thus configured image recording drum 52 thereby conveys each of the sheet members P towards the ink drying section 20 by rotating, with the leading edge portions of the sheet member P that has been passed across from the process liquid drying drum 46 retained by the grippers 52A and the sheet member P wrapped around the peripheral face of the image recording drum 52.

The image recording drum 52 and the process liquid drying drum 46 of the present exemplary embodiment are disposed with the grippers 52A (46A) at 2 locations on the outer peripheral face, in a configuration capable of conveying two sheets of the sheet member P with a single rotation.

A multitude of suction holes (not shown in the drawings) are formed in the outer peripheral face of the image recording drum 52. The sheet member P wrapped around the peripheral face of the image recording drum 52 is accordingly conveyed while retained suction-attached to the peripheral face of the image recording drum 52 due to suction through the suction holes.

The press roller 54 is disposed in the vicinity of the sheet member receiving position of the image recording drum 52 (the position where the sheet member P is received from the process liquid drying drum 46). The press roller 54 is configured from a rubber roller, and is disposed so as to press the peripheral face of the image recording drum 52. The sheet member P accordingly makes close contact with the peripheral face of the image recording drum 52 due to passing through the nip portion between the press roller 54 and the image recording drum 52.

The recording heads 56 are configured as full line heads corresponding to the sheet member width and disposed at fixed separations on the conveying direction downstream side of the press roller 54. A nozzle face (not shown in the drawings) formed with nozzles for jetting liquid droplets is provided to each of the recording heads 56 so as to face towards the peripheral face of the image recording drum 52.

A water-based UV ink is employed as the ink jetted from each of the recording heads 56. The water-based UV inks can be cured by irradiation with ultraviolet (UV) after droplet dotting.

Each of the ink compositions of the present exemplary embodiment contains a pigment, and may be formulated containing a dispersant, a surfactant and/or other such components as required. The ink compositions contain at least one type of pigment as a colorant component. There are no particular limitations to such pigments and pigments may be selected according to the application. The pigments may, for example, be organic pigments or inorganic pigments. The pigments employed are preferably pigments substantially insoluble in water, or difficult to dissolve in water, from the perspective of ink coloration ability. The pigments are also preferably water dispersible pigments with at least part of the surface of the pigment covered by a polymer dispersant.

The ink compositions of the present exemplary embodiment may contain one or more types of dispersant. Dispersants for the pigments may be a polymer dispersant or a low molecular weight surfactant dispersant. Such a polymer dispersant may be a water soluble dispersant or a water insoluble dispersant.

The weight-average molecular weight of such a polymer dispersant is preferably 3000 to 100,000, more preferably 5000 to 50,000, even more preferably 5000 to 40,000, and most preferably 10,000 to 40,000.

The acid value of the polymer dispersant is preferably 100 KOHmg/g or lower from the perspective of good aggregation ability on contact with the process liquid. The acid value is more preferably 25 to 100 KOHmg/g, even more preferably 25 to 80 KOHmg/g and most preferably 30 to 65 KOHmg/g. Good stability of self-dispersibility is achieved when the acid value of the polymer dispersant is 25 or above.

From the perspectives of self-dispersibility and speed of aggregation when the process liquid makes contact, the polymer dispersant preferably contains a polymer with a carboxyl group, and more preferably includes a polymer with a carboxyl group and an acid value of 25 to 80 KOHmg/g.

The present exemplary embodiment preferably contains a pigment and a dispersant from the perspectives of light-fastness and quality of the images, more preferably includes an organic pigment and a polymer dispersant, and most preferably includes a polymer dispersant containing an organic pigment and a polymer dispersant containing a carboxyl group. From the perspective of aggregation ability the pigment is preferably covered by a polymer dispersant containing a carboxyl group and is preferably insoluble in water. From the perspective of aggregation ability the acid value of self-dispersing polymer particles, described later, is preferably smaller than the acid value of the polymer dispersant.

The average particle size of the pigment is preferably 10 to 200 nm, more preferably 10 to 150 nm, and even more preferably 10 to 100 nm. Good color reproducibility is achieved and good droplet dotting characteristics are achieved when droplets are dotted using an inkjet method when the average particle size is 200 nm or less, and there is good light-fastness when the average particle size is 100 nm or less. There are no particular limitations to the size distribution of particles of colorant, and both wide range of particle size distributions and particle size distribution with monodispersed may be employed. Configuration may also be made using a mixture of two or more colorants having particle size distributions with mono-distribution characteristics.

The average particle size and the particle size distribution of colorant (pigment particles) may be determined by measuring the volume average particle size with a dynamic light scattering method using a Nanotrack UPA-EX150 particle size analyzer (manufactured by Nikkso Co., Ltd.).

The pigment may employ a single type of pigment on its own, or a combination of two or more types may be employed. The amount of pigment contained in the ink compositions is preferably from 1 to 25 percent by weight of the ink composition from the perspective of image density, more preferably 2 to 20 percent by weight thereof, even more preferably 5 to 20 percent by weight, and most preferably 5 to 15 percent by weight.

The ink compositions of the present exemplary embodiment may be configured to contain one or more types of polymer particle. The polymer particles have the function of solidifying the ink composition by making the dispersion unstable when the polymer particles make contact with the process liquid, described later, or the region where the process liquid has been dried, thereby aggregating and making the ink more viscous. The polymer particles can accordingly raise the adhesion of the ink compositions to the recording medium and can also enhance resistance to rubbing of the images.

Polymer particles are employed having an anionic surface charge so as to react with the aggregating agent, and widely known latexes are employed in a range that obtains both sufficient reaction ability and jetting stability. However polymer particles with self-dispersing properties are particularly preferably employed.

The ink compositions of the present exemplary embodiment preferably include as polymer particles at least one type of self-dispersing polymer particles. Such self-dispersing polymer particles have the function of solidifying the ink composition by making the dispersion unstable when the self-dispersing polymer particles make contact with the process liquid, described later, or the region where the process liquid has been dried, thereby aggregating and making the ink more viscous. The self-dispersing polymer particles can accordingly raise the adhesion of the ink compositions to the recording medium and can also enhance resistance to rubbing of the images. The self-dispersing polymer particles are preferably resin particles from the perspectives of jetting stability and liquid stability (in particular dispersion stability) of a pigment containing system.

Such self-dispersing polymer particles are water insoluble polymers that obtain a dispersed state in an aqueous medium by functional groups (in particular acidic groups or salts thereof) on the polymer itself under conditions in which there is no other surfactant present, and means polymer particles insoluble in water not containing free emulsifying agent.

The acid value of self-dispersing polymer in the present exemplary embodiment is preferably 50 KOHmg/g or lower from the perspective of giving good aggregation ability when contact is made with the process liquid. The acid value thereof is more preferably 25 to 50 KOHmg/g, and even more preferably from 30 to 50 KOHmg/g. Good stability self-dispersal is achieved when the acid value of the self-dispersing polymer is 25 or above.

The particles of self-dispersing polymer of the present exemplary embodiment preferably include a polymer with a carboxyl group from the perspectives of self-dispersing ability and aggregation speed when contact is made with the process liquid, more preferably include a polymer that has a carboxyl group and also has an acid value of 25 to 50 KOHmg/g, and even more preferably the particles include a polymer with a carboxyl group and have an acid value of 30 to 50 KOHmg/g.

The weight-average molecular weight of a water insoluble polymer forming the particles of the self-dispersing polymer is preferably 3000 to 200,000, is more preferably 5000 to 150,000, and is even more preferably 10,000 to 100,000. The amount of water soluble components can be efficiently suppressed when the weight-average molecular weight is 3000 or more. The self-dispersing stability can be raised when the weight-average molecular weight is 200,000 or lower.

The weight-average molecular weight is measured by gel permeation chromatography (GPC). GPC here uses HLC-8220GPC (manufactured by Tosoh Corporation) employing three columns of TSKgeL Super HZM-H, TSKgeL Super HZ4000, and TSKgeL Super HZ2000 (manufactured by Tosoh Corporation with dimensions of 4.6 mm ID×15 cm) and uses THF (tetrahydrofuran) as the eluting solution. The measurement conditions are a sample concentration of 0.35/minute, a flow rate of 0.35 mL/minute, sample injection amount 10 μL, and a measurement temperature of 40° C. An IR detector is used for the measurement.

Standard curves are also obtained from eight samples, standard sample TSK standard polystyrenes F-40, F-20, F-4, F-1, A-5000, A-2500, A-1000 (manufactured by Tosoh Corporation) and n-propylbenzene.

The volume-average particle size of the self-dispersing polymer particles is preferably in the range from 10 nm to 400 nm, more preferably in the range from 10 nm to 200 nm, and even more preferably in the range from 10 nm to 100 nm. The suitability for manufacture is enhanced when the volume-average particle size is 10 nm or greater and storage stability is enhanced when the volume-average particle size is 1 μm or less.

The average particle size and the particle size distribution of the self-dispersing polymer particles are derived from measuring volume-average particle size using dynamic light scattering with a NANOTRAC UPA EX150 particle size distribution measuring instrument (manufactured by Nikkiso Co., Ltd).

One type of the self-dispersing polymer particles may be used alone or a mixture of two or more types of self-dispersing polymer particles may be employed. The content of the self-dispersing polymer particles in the ink composition is preferably from 1 to 30 percent by weight with respect to the ink composition from such perspectives as aggregation speed and glossiness of images, and more preferably from 5 to 15 percent by weight.

The content ratio of pigments to self-dispersing polymer particles in the ink compositions (for example water insoluble pigment particles/self-dispersing polymer particles) is preferably in the range of from 1/0.5 to 1/10 from the perspective of rubbing resistance of images, and more preferably in the range of from 1/1 to 1/4.

The ink composition of the present exemplary embodiment may include one or more type of water-soluble polymerizable compound that is polymerizable with actinic radiation energy. The polymerizable compound is preferably a nonionic or cationic polymerizable compound from the perspective of not interfering with the aggregating agent's reaction with the pigment and the polymer particles. Reference to water soluble means a compound that can dissolve to a specific concentration or greater in water, or a compound that can dissolve (preferably uniformly) in a water-based ink. The compound may be a compound that dissolves (preferably uniformly) in ink with raised solubility due to addition of a water miscible organic solvent. More specifically, the solubility in water is preferably 10 percent by weight or greater, and more preferably 15 percent by weight or greater.

A nonionic or cationic polymerizable compound is preferably employed as the polymerizable compound from the perspective of not interfering with the aggregating agent's reaction with the pigment and the polymer particles, and a polymerizable compound with a solubility in water of 10 percent by weight or greater (and more preferably 15 percent by weight or greater) is preferably employed.

The polymerizable compound of the present exemplary embodiment is preferably a poly-functional group monomer, and more preferably a two to six functional group monomer, from the perspective of achieving high rubbing resistance. The polymerizable compound is preferably a two to four functional group monomer from the perspectives of achieving both solubility and rubbing resistance. A single type of the polymerizable compound may be included alone or a combination of two or more types of the polymerizable compound may be employed.

The contained amount of the polymerizable compound in the ink compositions is preferably 30 to 300 percent by weight with respect to the total solid components of the pigment(s) and the self-dispersing polymer particles, and more preferably 50 to 200 percent by weight. Excellent rubbing resistance of images is achieved when the contained amount of the polymerizable compound is 30 percent by weight or greater, and a contained amount of 300 percent by weight or less is beneficial from the pile height perspective.

At least one of the ink composition and/or the process liquid also includes an initiator for initiating polymerization of the actinic radiation energy polymerizable compound.

The ink composition of the present exemplary embodiment may be an ink composition containing one or more initiator, for initiating polymerization of the actinic radiation energy polymerizable compound, and the initiator(s) may also be contained in the process liquid or may not be contained in the process liquid. A single type of photo-polymerization initiator may be employed alone or a mixture of two or more types of photo-polymerization initiator may be employed, and a sensitizer may also be employed in combination therewith.

The initiator may contain a suitably selected compound that achieves initiation of a polymerization reaction with actinic radiation energy. For example an initiator (for example a photopolymerization initiator) may be employed that generates an active species (such as a radical, acid or salt) on irradiation with radiation, light or an electron beam.

When an initiator is contained the initiator is preferably contained in the ink composition at 1 to 40 percent by weight with respect to the polymerizable compound, and more preferably at 5 to 30 percent by weight. The rubbing resistance is enhanced when the contained amount of the initiator is 1 percent by weight or greater and such a contained amount is also beneficial for high speed recording. It is beneficial from the perspective of jetting stability for the contained amount of the initiator to be 40 percent by weight or less.

One or more types of water miscible organic solvent may be contained in the ink composition of the present exemplary embodiment. The water miscible organic solvent can achieve the advantageous effects of drying inhibition, wetting and/or penetration promotion. Preferably a water miscible organic solvent is employed as a drying inhibitor to prevent ink from adhering and drying at the ink jetting apertures of the jetting nozzles and prevent aggregated bodies forming that block the apertures, and a water miscible organic solvent with lower vaporization pressure than water is preferably employed as a drying inhibitor and wetting agent. The water miscible organic solvent may also be employed as a penetration promoter to raise the ink penetration properties to paper.

A water miscible organic solvent having a lower vaporization pressure than water is preferably employed as a drying inhibitor. A single type of drying inhibitor may be employed on its own or a combination of two or more types may be employed. The amount of the drying inhibitor contained in the ink is preferably in the range of 10 to 50 percent by weight.

A penetration promoter is appropriately employed in order to give good penetration of the ink composition into the recording medium (such as printing paper). A single type of penetration promoter may be employed alone or a combination of two or more types may be employed. The amount of the penetration promoter contained in the ink composition is preferably in the range of 5 to 30 percent by weight. The penetration promoter is preferably employed at an amount within a range that does not cause image bleeding or print-through.

The ink composition contains water, however there is no particular limitation to the amount of water contained. A preferable amount of water contained is 10 to 99 percent by weight, with 30 to 80 percent by weight being more preferable and 50 to 70 percent by weight being even more preferable.

The ink composition of the present exemplary embodiment may also be configured with other additives other than the components described above. Examples of such other additives include known additives such as a drying inhibitor (wetting agent), an anti-fading agent, an emulsion stabilizer, a penetration promoter, an ultraviolet absorber, an antiseptic, a fungicide, a pH regulator, a surface tension regulator, a defoaming agent, a viscosity regulator, a dispersant, a dispersion stabilizer, a rust preventing agent and/or a chelating agent The inline sensor 58 is disposed at a fixed separation on the conveying direction downstream side of the recording heads 56. The inline sensor 58 reads image data formed on the sheet member P by each of the recording heads 56. A contact prevention plate 59 is disposed at the conveying direction downstream side of the inline sensor 58 to prevent the sheet member P from making contact with the inline sensor 58. The contact prevention plate 59 is configured so as to prevent the sheet member P from making contact with the inline sensor 58 when lifting of the sheet member P occurs due for example to poor conveying.

The mist filter 60 is disposed between the recording heads 56 and the inline sensor 58 so as to suck in air at the periphery of the image recording drum 52 and capture any ink mist. The ink mist is thereby suppressed from penetrating to the inline sensor 58, so as to thereby prevent read problems from arising.

The drum cooling unit 62 is provided facing a portion of the lower peripheral face of the image recording drum 52 and is configured mainly including an air conditioner (not shown in the drawings) and a duct 62A to blow the cooled air fed from the air conditioner onto the peripheral face of the image recording drum 52.

Ink Drying Section

The ink drying section 20 is configured to mainly include: a chain gripper 64 serving as an example of a conveying member for conveying the sheet member P on which images have been formed; suction-attachment plates 72 for applying tension to the sheet member P being conveyed by the chain gripper 64; and an ink drying unit 68 for drying the sheet member P being conveyed by the chain gripper 64.

The chain gripper 64 is equipped with chain bodies 64A each configured with: a first sprocket 63A disposed in the vicinity of the image recording drum 52; a second sprocket 63B rotatably provided to the paper discharge section 24; an endless chain 63C entrained around the first sprocket 63A and the second sprocket 63B; and plural chain guides (not shown in the drawings) for guiding travel of the endless chain 63C. The first sprocket 63A is provided with a drive source (not shown in the drawings) for rotating the first sprocket 63A.

Two of the chain bodies 64A are provided at a separation from each other along the sheet member P width direction. Plural individual grippers 64B serving as examples of retaining members are provided spanning across between the pair of chain bodies 64A to retain the leading edge portions of the sheet member P being conveyed.

In other words the chain gripper 64 is configured including the pair of chain bodies 64A and the plural individual grippers 64B.

The chain guides are disposed at specific positions so as to guide the travel of each of the endless chains 63C along a specific path. In the image forming apparatus 10 of the present exemplary embodiment the second sprocket 63B is disposed in a position higher than the first sprocket 63A. The endless chain 63C is therefore formed with a travel path that is inclined at an intermediate portion thereof. Specifically the path of the endless chain 63C is configured with a first horizontal conveying path 70A at similar height to the first sprocket 63A, an inclined conveying path 70B, and a second horizontal conveying path 70C at similar height to the second sprocket 63B. Chain guides are accordingly provided at the intersection points of each of these paths where the progression direction changes.

The suction-attachment plates 72 are disposed along the conveying path along which the sheet members P are conveyed by the chain grippers 64. More specifically the suction-attachment plates 72 are disposed along the endless chain 63C at the first horizontal conveying path 70A and the inclined conveying path 70B traveling sections.

Fans 82 are provided inside each of the suction-attachment plates 72 so as to generate suction-attachment force to suction-attach the back face of each of the sheet members P to a suction-attachment face 72A of the suction-attachment plate 72 (the face facing towards the chain gripper 64 side).

Each of the sheet members P retained at leading edge portions by the chain gripper 64 is thereby conveyed while sliding along the suction-attachment face 72A of the suction-attachment plate 72, such that tension is induced in the sheet member P.

The ink drying unit 68 is disposed on the opposite side of the conveyed sheet member P to the side of the suction-attachment plate 72 disposed on the first horizontal conveying path 70A. The ink drying unit 68 is equipped with plural individual infrared heaters 78 for blowing hot air onto the front face of the conveyed sheet member P so as to heat and dry the sheet member P.

Details regarding the configuration of the ink drying section 20 are described later.

UV Irradiation Section

The UV irradiation section 22 is equipped with a UV irradiation unit 74, an example being an ultraviolet lamp, for irradiating ultraviolet radiation onto the sheet member P conveyed by the chain gripper 64. The UV irradiation unit 74 thereby irradiates ultraviolet radiation (UV) onto images formed on the sheet member P, so as to fix the images onto the sheet member P.

Paper Discharge Section

The paper discharge section 24 is equipped with a paper discharge plate 76 for accumulating together the UV irradiated sheet members P released from the grippers 64B, stacked one on top of each other. The paper discharge plate 76 is equipped with a raising and lowering device (not shown in the drawings) that always positions the uppermost sheet member P stacked on the paper discharge plate 76 at a constant height. The paper discharge section 24 thereby accumulates the sheet members P that have been subjected to a cycle of image recording processing by stacking the sheet members P on the paper discharge plate 76.

Due to the configuration described above, sheet members P stacked on the paper feed plate 30 in the paper feeder 12, for forming images on the front face of the sheet members P, are picked up in sequence one sheet at a time by the sucker device 32 and fed into the paper feed rollers 34. Each of the sheet members P fed into the paper feed rollers 34 is then fed out towards the conveyor belt 36 and placed on the conveyor belt 36.

Each of the sheet members P mounted on the conveyor belt 36 is conveyed by the rotating conveyor belt 36. In the conveying process the sheet member P is pressed against the conveying face of the conveyor belt 36 by the retainers 36B so as to correct undulations in the sheet member P. The leading edge portions of the sheet member P conveyed by the conveyor belt 36 make contact with the front stop 38, thereby correcting any skewing. The sheet member P is then passed across to the paper feed drum 40. The sheet member P is then conveyed towards the process liquid application section 14 by the paper feed drum 40.

In the process liquid application section 14 the sheet member P that has been passed across from the paper feed drum 40 is received by the process liquid application drum 42. The process liquid application drum 42 wraps the sheet member P onto the peripheral face of the process liquid application drum 42 and conveys the sheet member P by rotating with the leading edge portions of the sheet member P retained by grippers 42A. The application roller 44A is pressed against the front face of the sheet member P during the conveying process, and the front face of the sheet member P is applied with process liquid (process liquid application process).

In the process liquid drying section 16 the sheet member P that has been passed across from the process liquid application drum 42 is received by the process liquid drying drum 46. The process liquid drying drum 46 conveys the sheet member P by rotating with the leading edge portions of the sheet member P retained by grippers 46A. When this is performed the process liquid drying drum 46 conveys the sheet member P with the front face (the process liquid applied face) facing towards the inside.

During the process of being conveyed by the process liquid drying drum 46, hot air from the process liquid drying units 50 disposed inside the process liquid drying drum 46 is blown against the sheet member P and the sheet member P is dried (process liquid drying process).

In the image recording section 18 the sheet member P that has been passed across from the process liquid drying drum 46 is received by the image recording drum 52. The image recording drum 52 conveys the sheet member P by rotating with the leading edge portions of the sheet member P retained by grippers 52A. The sheet member P received by the image recording drum 52 is made to make close contact with the peripheral face of the image recording drum 52 by passing through between the image recording drum 52 and the press roller 54. At the same time a suction is applied through suction holes in the image recording drum 52, such that sheet member P is suction-attached to the outer peripheral face of the image recording drum 52.

The sheet member P is conveyed in this state so as to pass through respective positions facing towards each color of the recording heads 56. Liquid droplets (ink) from each color recording head 56 are dotted as droplets onto the front face of the passing sheet member P so as to form a colored image on the front face (image forming process).

The sheet member P formed with images of each color by the recording heads 56 then passes through a position facing towards the inline sensor 58. Image data formed on the front face of the sheet member P is read as the sheet member P passes the inline sensor 58. Such image data reading is performed as required in order to check for such problems as poor jetting in the read images. Abnormalities such as poor jetting can accordingly be detected immediately, thereby rapidly enabling countermeasures to be performed.

In the ink drying section 20 the sheet member P that has been passed across from the image recording drum 52 is received by the chain gripper 64. The chain gripper 64 conveys the sheet member P along the suction-attachment plate 72 with leading edge portions of the sheet member P retained by the grippers 64B.

The sheet member P that has been passed across to the chain gripper 64 is conveyed along the first horizontal conveying path 70A. During the process of conveying along the first horizontal conveying path 70A the sheet member P is heated and dried by the infrared heaters 78 (liquid droplet drying process).

In the UV irradiation section 22 ultraviolet radiation from the UV irradiation unit 74 is irradiated onto the front face of the sheet member P being conveyed along the inclined conveying path 70B by the chain gripper 64. UV irradiation processing is thereby performed on the image formed on the sheet member P so as to fix the image onto the sheet member P (light illumination process).

In the paper discharge section 24 the sheet members P that have been UV irradiated and released from the grippers 64B are stacked on the paper discharge plate 76 and accumulated. The sheet members P that have been subjected to one cycle of image recording processing are thereby collected together on the paper discharge plate 76, stacked one on each other.

Configuration of the Relevant Portion

Detailed explanation follows regarding such aspects as configuration of the ink drying section 20.

Figure 2:
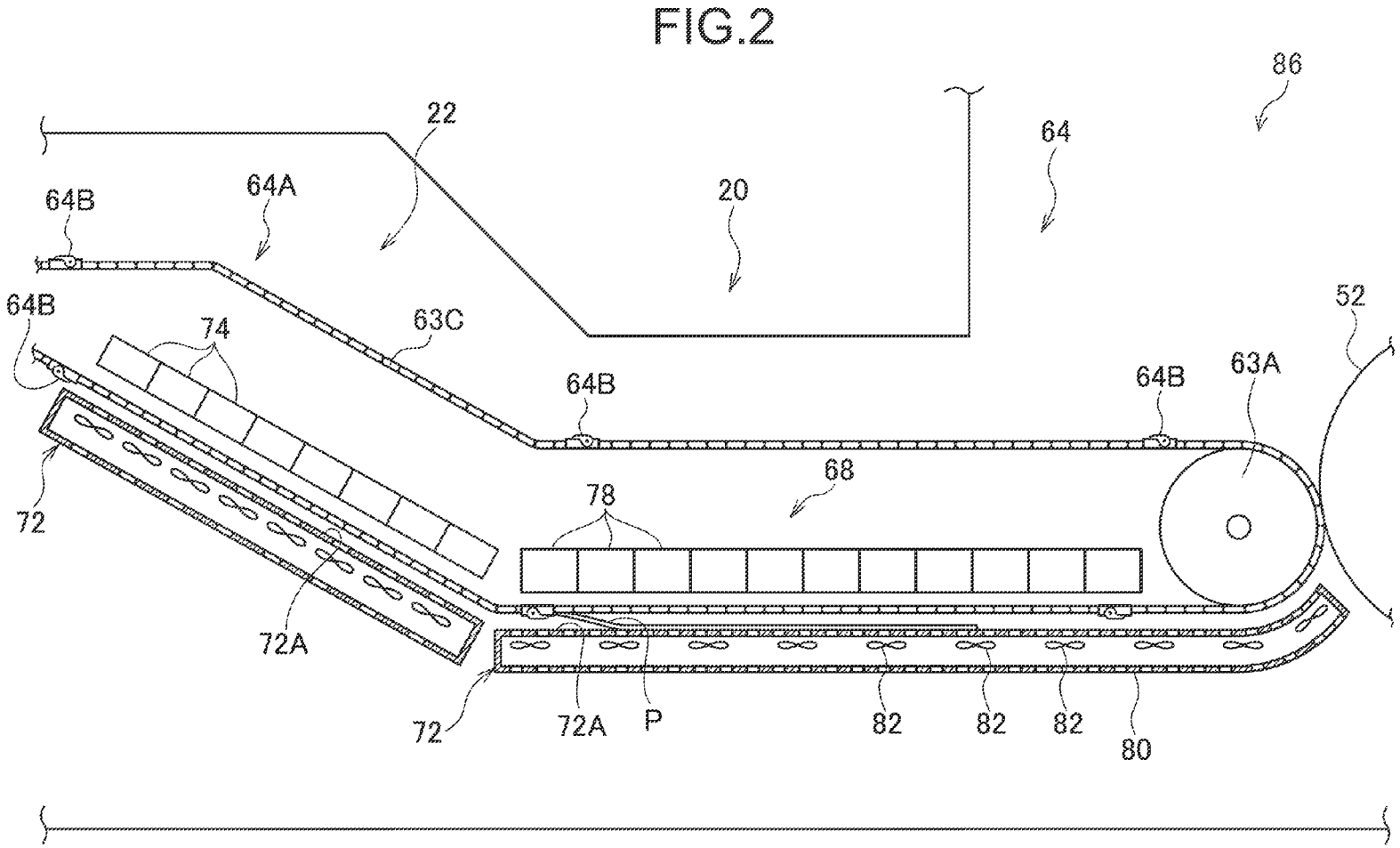
FIG. 2 is a configuration diagram illustrating suction-attachment plates, a chain gripper, and infrared heaters employed in an image forming apparatus according to the first exemplary embodiment.
Figure 3:
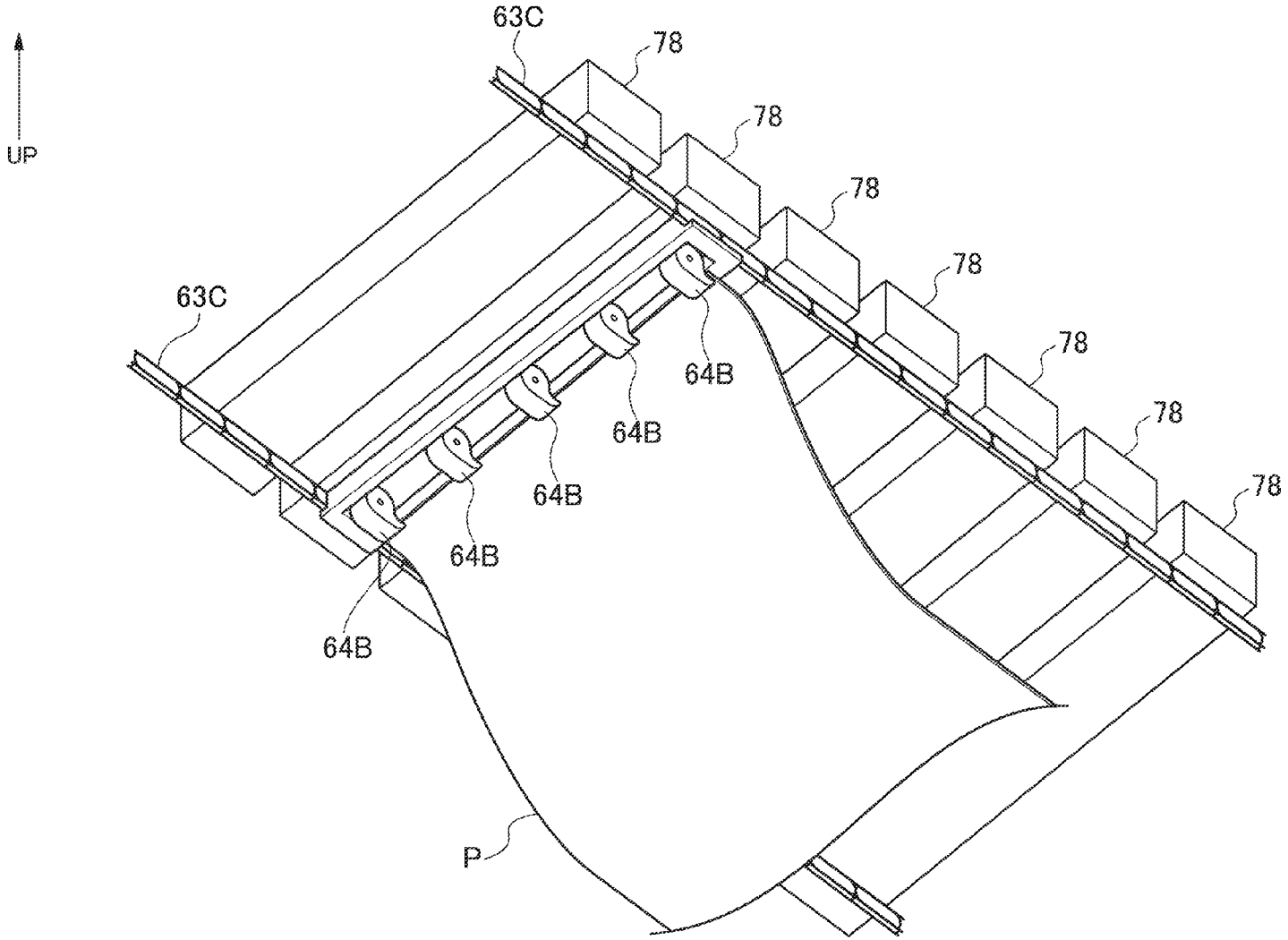
FIG. 3 is a perspective view illustrating a chain gripper and infrared heaters employed in an image forming apparatus according to the first exemplary embodiment.

As shown in FIG. 2, the suction-attachment plate 72 is equipped with a box shaped casing 80 formed with multiple suction holes and discharge holes in the outer peripheral face of the casing 80, and with the fans 82 that generate suction force towards the suction-attachment face 72A of the casing 80 (the face facing towards the chain gripper 64 side).

Such a configuration results in the back face of each of the sheet members P being conveyed with the leading edge portions retained by the grippers 64B of the chain gripper 64 being suction-attached onto the suction-attachment face 72A. The sheet member P is thereby conveyed while sliding along the suction-attachment face 72A of the suction-attachment plate 72 such that tension is induced in the sheet member P, pulling the sheet member P along the sheet member P conveying direction.

Namely a tension applying device 86 is configured from the chain gripper 64 and the suction-attachment plate 72 and serves as an example of a tension applying member for inducing tension in the sheet member P acting along the sheet member P conveying direction.

The suction force of the suction-attachment face 72A and the conveying force of the chain gripper 64 are determined so as to induce a tension in the sheet member P of 100 N/m to 1000 N/m.

As shown in FIG. 1, the plural individual infrared heaters 78 provided to the ink drying unit 68 are disposed on the opposite side of the conveyed sheet member P to the suction-attachment plate 72 side, as described above, so as to form a row along the sheet member P conveying direction.

The output of each of the infrared heaters 78 is determined such that the residual moisture level in the sheet member P becomes 3 g/m$^2$ when the tension induced in the sheet member P by heating and drying the sheet member P with all the infrared heaters 78.

The residual moisture level here refers to the ink component residual moisture level and does not consider the moisture originally present in the sheet member P. For example, when the ink moisture amount of dotted liquid droplets of ink is 10 g/m$^2$ then configuration is made such that this ink moisture amount becomes 3 g/m$^2$ or lower by drying the sheet member P.

The machine direction of the sheet member P employed in the image forming apparatus 10 of the present exemplary embodiment is, for example, orthogonal to the sheet member P conveying direction. Namely, tension is applied to the sheet member P in a direction orthogonal to the machine direction. The machine direction referred to here is the direction along which paper fibers are aligned.

Operation and Advantageous Effects of the Relevant Portion

Explanation follows regarding the operation and advantageous effects of the relevant portion.

As shown in FIG. 1 and FIG. 2, in the ink drying section 20 the sheet member P that has been passed across from the image recording drum 52 is received by the chain gripper 64. The grippers 64B retain leading edge portions of the sheet member P in the chain gripper 64, and the chain gripper 64 conveys the sheet member P along the suction-attachment plate 72.

More specifically, as shown in FIG. 1, in the above liquid droplet drying process the leading edge portions of the sheet member P are retained by the grippers 64B of the chain gripper 64 and the sheet member P is conveyed towards the conveying direction downstream side by the chain gripper 64 with the leading edge portions in a retained state. The back face of the conveyed sheet member P is also suction-attached to the suction-attachment face 72A of the suction-attachment plate 72.

The sheet member P is accordingly conveyed while sliding along the suction-attachment face 72A of the suction-attachment plate 72, such that tension of 100 N/m to 1000 N/m is induced in the sheet member P pulling the sheet member P along the conveying direction.

The infrared heaters 78 also reduce the residual moisture level of the sheet member P to 3 g/m$^2$ or less by heating and drying the conveyed sheet member P when the tension induced in the sheet member P.

Swelling due to the moisture present in the inks occurs in the sheet member P when images are formed on the sheet member P using a water-based inkjet method. Sometimes waviness occurs in the sheet member P due to the uneven nature of the swelling, which occurs according to the image density, along the plane of the sheet member P.

Some reduction in waviness is seen when the moisture applied to the sheet member P can be evaporated by heating and drying the sheet member P after forming an image with water-based inks, however waviness is not reduced to zero.

Reasons for such waviness are thought to be firstly because the ink penetrates into the sheet member P faster than the ink moisture can be dried, and secondly because shrinkage of the sheet member P occurs due to moisture in regions of low image density, and in particular non-image regions, being evaporated by heating and drying.

While it might be thought to be effective to induce a strong tension in the sheet member P to correct waviness occurring in the sheet member P, when the sheet member P is dried in such a stretched-out state (in a state in which tension is induced), this is thought to lead to a reduction in graphic precision (the precision of dimensions of graphics required to be of original rendered dimensions).

Evaluation Device

Evaluation is therefore performed of the waviness occurring in the sheet member P and the graphic precision (the precision of dimensions of graphics required to be of the original rendered dimensions).

Evaluation Device and Evaluation Members

The sheet members P employed in evaluation are coated paper, OK TOPCOAT PLUS (trade name) manufactured by Oji Paper Co., Ltd. with a basis weight of 104.7 gsm, width direction dimension of 150 mm and conveying direction dimension of 150 mm. The evaluation sheet members P were pre-coated with process liquid.

Figure 5A:
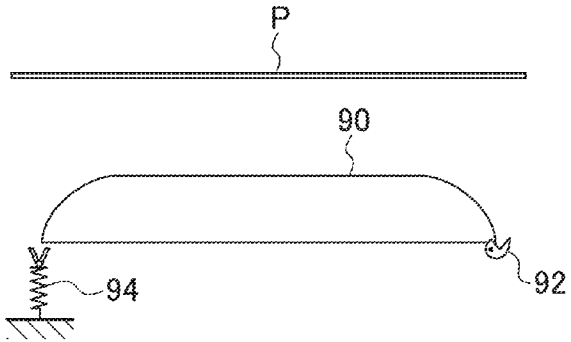
FIG. 5A is a configuration diagram illustrating an evaluation device employed for evaluating an image forming apparatus according to the first exemplary embodiment of the present invention.
Figure 5B:
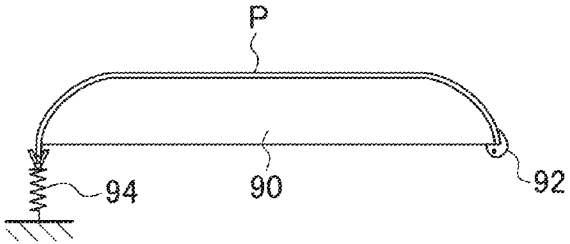
FIG. 5B is a configuration diagram illustrating an evaluation device employed for evaluating an image forming apparatus according to the first exemplary embodiment of the present invention.
Figure 5C:
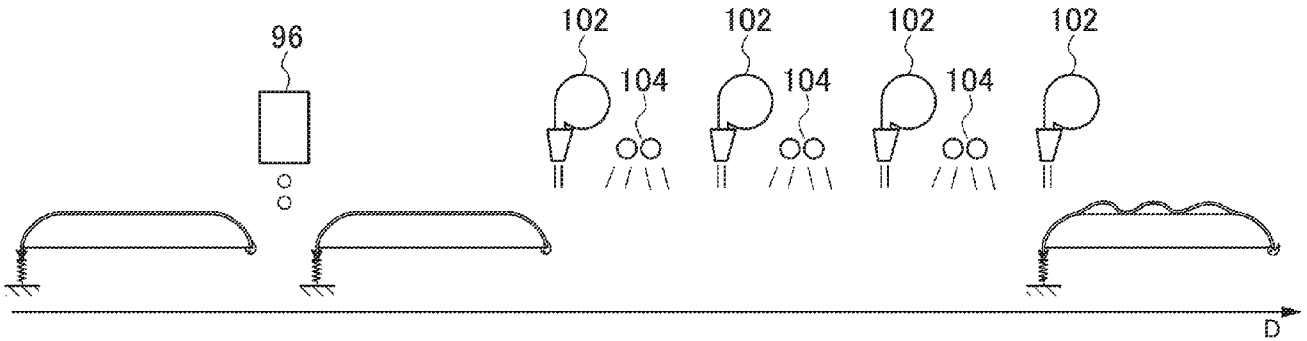
FIG. 5C is a configuration diagram illustrating an evaluation device employed for evaluating an image forming apparatus according to the first exemplary embodiment of the present invention.

FIG. 5A, FIG. 5B and FIG. 5C show an evaluation device employed for evaluation. As shown in FIG. 5A and FIG. 5B, the sheet member P is set on a base 90 that curves around at the leading end side and the trailing end side. Clippers 92 are provided at the leading end side of the base 90 for retaining leading edge portions of the sheet member P, and spring members 94 for inducing tension in the sheet member P are provided at the trailing end side of the base 90 for pulling trailing end portions of the sheet member P. A specific tension is thereby induced in the sheet member P that has been set in the base 90. Similarly to in the image forming apparatus 10, the present evaluation imparts tension in a direction orthogonal to the machine direction.

As shown in FIG. 5C, in the evaluation device a conveying means (not shown in the drawings) is provided for conveying the sheet member P set on the base 90 in the arrow D direction at a speed of 500 mm/s. A recording head 96 is also provided to the evaluation device for jetting ink (black ink) towards the conveyed sheet member P. Hot air heaters 102 and infrared radiation heaters 104 are also provided disposed with a separation of 30 mm to the conveyed sheet member P.

More specifically, there are four units of the hot air heaters 102 provided, and three units of the infrared radiation heaters 104 provided, with the hot air heaters 102 and the infrared radiation heaters 104 disposed so as to alternate with each other. The hot air heaters 102 are configured to blow hot air at 30° C. to 80° C. onto the front face of the sheet member P at a speed of 10 m/s. The infrared radiation heaters 104 each have an output of from 10 W/cm to 60 W/cm.

Figure 6:
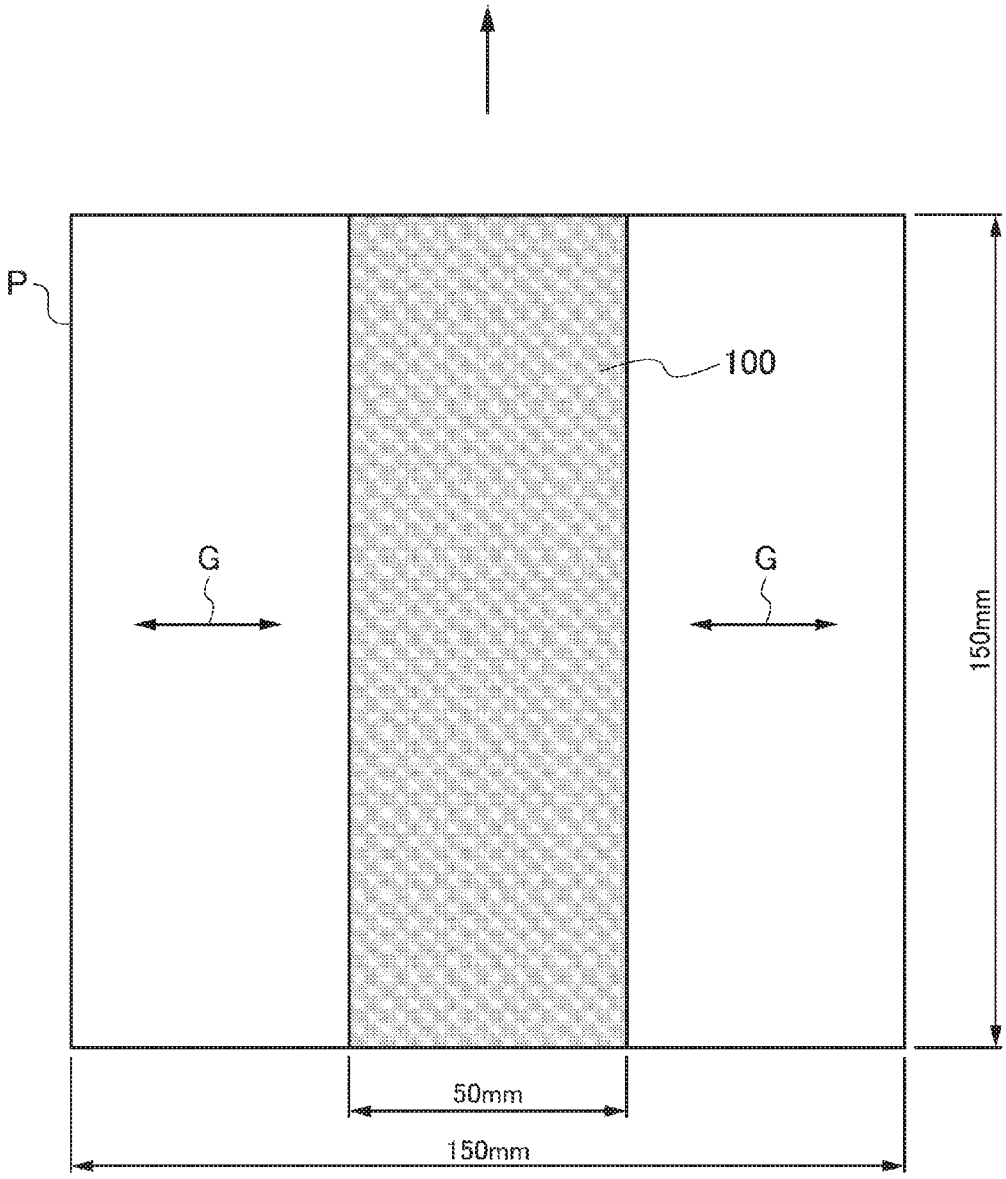
FIG. 6 is a diagram illustrating a sheet member employed for evaluating an image forming apparatus according to the first exemplary embodiment of the present invention.

As shown in FIG. 6, the evaluation device is employed to jet ink from the recording head 96 onto the sheet member P so as to form a solid print region 100 at the central side of the sheet member P extending across a width of 50 mm from the leading end portion to the trailing end portion of the sheet member P. The tension induces in the sheet P by the spring members 64. More specifically, the recording head 96 forms the solid print region 100 by dotting 6 pL droplets of ink onto the sheet member P at 1200 dpi (ink droplet dotting amount 13.0 g/m$^2$). The solid print region 100 and white margins are combined together in a pattern formed on the sheet member P that readily generates waviness.

The sheet member P formed with the solid print region 100 is conveyed at a speed of 500 mm/s and passes through positions facing towards the hot air heaters 102 and the infrared radiation heaters 104 such that the image formed on the front face of the sheet member P is dried when the tension induced in the sheet P by the spring members 64.

Evaluation is performed using the evaluation device while changing the tension imparted to the sheet member P and changing the residual moisture level of the sheet member P after drying with the hot air heaters 102 and the infrared radiation heaters 104.

The process liquid formulation and ink formulation employed in evaluation are as listed below.

Process Liquid Formulation

| | |
|---|---|
| Malonic acid: | 10 parts by weight |
| Diethyleneglycol monobutylether: | 20 parts by weight |
| Olfine E1010 (manufactured by Nisshin Chemical Co., Ltd.): | 1 part by weight |
| Ion-exchange water: | Balance |

Ink Formulation

| | |
|---|---|
| Pigment: | 4 parts by weight |
| Dispersant polymer: | 2 parts by weight |
| Resin emulsion: | 8 parts by weight |
| Water miscible organic solvent | 15 parts by weight |
| Olfine E1010 (manufactured by Nisshin Chemical Co., Ltd.): | 1 part by weight |
| Ion-exchange water: | Balance |
| Pigment: | Cromophtal Jet Magenta DMQ (PR-122) manufactured by Ciba Specialty Chemicals |
| Dispersant polymer: | Benzyl methacrylate/methyl methacrylate/methacrylic acid copolymer |
| Mass ratio: | 60/30/10 |
| Resin emulsion: | Methyl methacrylate/phenoxyethyl acrylate/acrylic acid copolymer |
| Mass ratio: | 66/29/5 |
| Glass transition temperature: | 65° C. |

Evaluation Method 1

Residual Moisture Level Evaluation Method: Evaluation performed by weighing

Waviness Evaluation Method: Performed by visual inspection against grading samples after releasing the tension induced in the sheet member P whose image has been dried using the above evaluation device.

Waviness Evaluation Criteria:

3.1 or above D: bad waviness outside permissible quality 2.1 to 3.0 C: visible waviness but within permissible quality 1.1 to 2.0 B: slight visible waviness not affecting quality 0.0 to 1.0 A: no visible waviness Graphic Precision Evaluation Method: compute and evaluate difference of graphic precision for dimensions of graphics required to be of the original rendered dimensions.

Graphic Precision Evaluation Criteria

Graphic precision difference less than 0.05%: A (permissible quality)

Graphic precision difference 0.05% to 0.10%: B (permissible quality)

Graphic precision difference 0.10% to 0.15%: C (permissible quality)

Graphic precision difference greater than 0.15%: D (not permissible quality)

Evaluation Result 1

Figure 7:
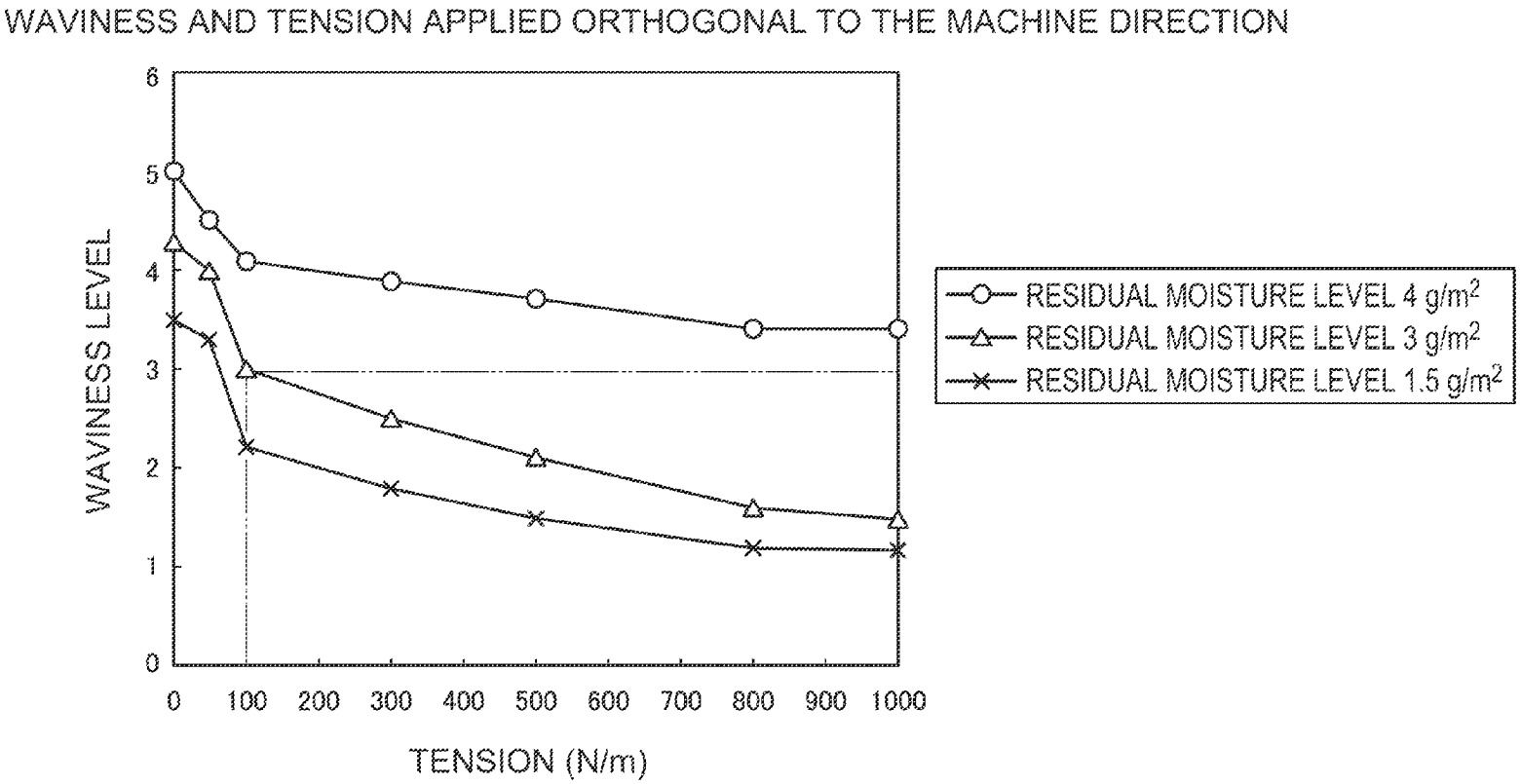
FIG. 7 is a graph illustrating evaluation results of evaluations of waviness related to an image forming apparatus according to the first exemplary embodiment of the present invention.

FIG. 7 shows a graph of waviness evaluation results. The vertical axis in FIG. 7 indicates the waviness level and the horizontal axis indicates the tension induced in the sheet member P. It can be seen from the graph that the waviness level is a permissible quality of 3 or less when the residual moisture level is 3 g/m$^2$ or less and the tension is 100 N/m or greater.

FIG. 8 shows a table of graphic precision evaluation results. It can be seen from the table that a permissible quality evaluation result for graphic precision of C results when the tension is 1000 N/m or less.

It can be seen from the above evaluation results that waviness can be suppressed from occurring and graphic precision quality can also be secured in the present exemplary embodiment since the tension induced in the sheet member P is from 100 N/m to 1000 N/m, and the sheet member P residual moisture level is 3 g/m$^2$ or less in the sheet member P that has been formed with an image and dried when the tension induced in the sheet P.

Waviness can be efficiently suppressed from occurring when the machine direction of the sheet member P for image forming is aligned orthogonally to the conveying direction of the sheet member P and tension is induced in the sheet member P along the sheet member P conveying direction.

The back face of the sheet member P is suction-attached to the suction-attachment face 72A of the suction-attachment plate 72 while being conveyed with the leading end portions of the sheet member P retained by the grippers 64B of the chain gripper 64. Tension is accordingly easily induced in the sheet member P along the sheet member P conveying direction.

The process liquid application unit 44 coats the sheet member P with aggregation process liquid for causing the colorant (pigment particles) in the liquid droplets (in the ink) to aggregate. Penetration of the liquid droplets (ink droplets) into the sheet member P can therefore be suppressed, and waviness can be efficiently suppressed from occurring in the sheet member P.

The process liquid coated on the sheet member P by the process liquid application unit 44 is also dried by the process liquid drying unit 50. The amount of softening of the sheet member P can be reduced by performing such drying of the moisture arising from the process liquid, thereby enabling waviness to be efficiently suppressed from occurring in the sheet member P.

Second Exemplary Embodiment

Figure 9:
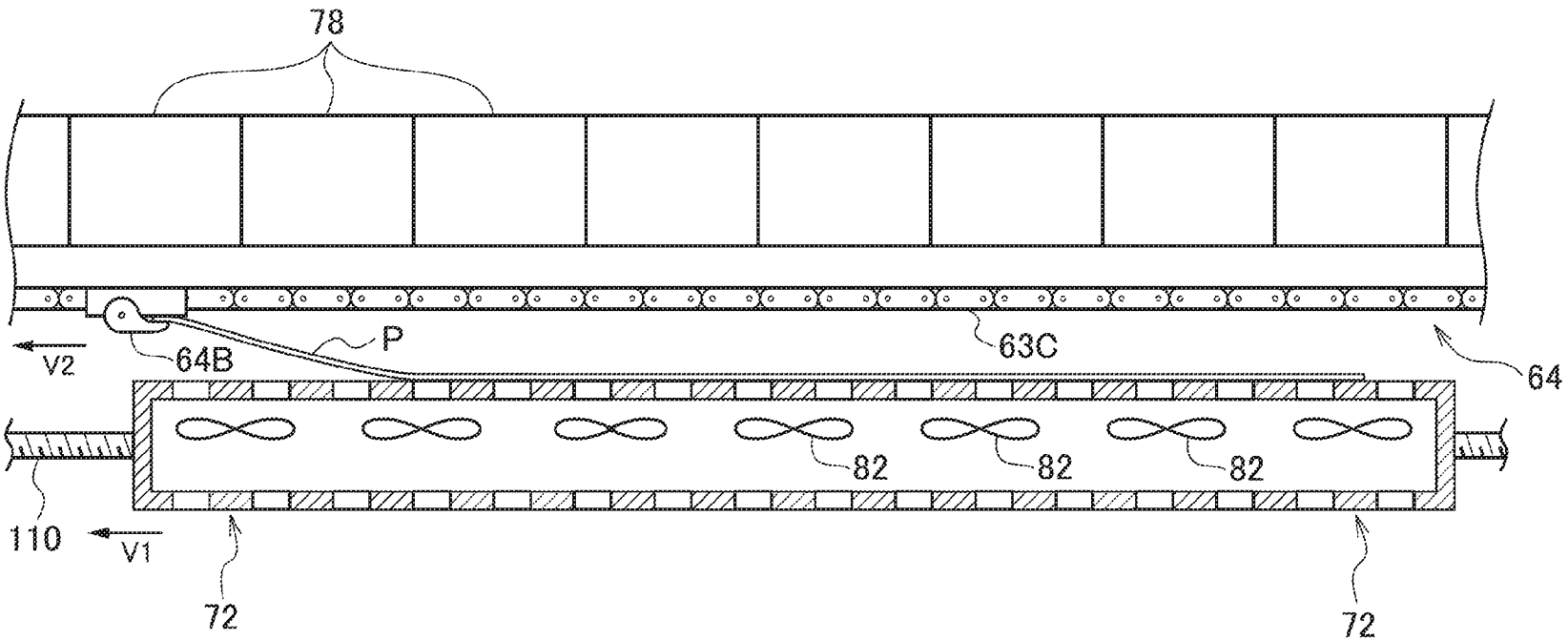
FIG. 9 is a side view illustrating a suction-attachment plate and a chain gripper employed in an image forming apparatus according to a second exemplary embodiment of the present invention.

Explanation follows regarding an image forming apparatus and an image forming method of a second exemplary embodiment of the present invention, with reference to FIG. 9. Similar members to those of the first exemplary embodiment are allocated the same reference numbers and further explanation is omitted.

As shown in FIG. 9, the second exemplary embodiment is provided with a suction-attachment plate 72 that is movable with respect to the apparatus main body. More specifically, a ball screw 110 serving as an example of a moving member extending in the sheet member P conveying direction is threaded into a nut (not shown in the drawings) formed to the suction-attachment plate 72. A stepping motor (not shown in the drawings) is also provided for rotating the ball screw 110 in a circumferential direction. The suction-attachment plate 72 is conveyed with the sheet member P in a suction-attached state towards the conveying direction downstream side at a speed V1 by rotating the stepping motor.

The speed V1 of the suction-attachment plate 72 is set so as to be slower than a speed V2 of the chain gripper 64 in which leading end portions of the sheet member P are retained. Tension is thereby induced in the sheet member P along the sheet member P conveying direction by thus making the speed V1 of the suction-attachment plate 72 slower than the speed V2 of the chain gripper 64.

Damage to the back face of the sheet member P when tension is being induced in the sheet member P can accordingly be suppressed since moving the suction-attachment plate 72 reduces the frictional force occurring between the back face of the sheet member P and the suction-attachment face 72A.

The conveying speed of the sheet member P due to the chain gripper 64 can also be speeded up by moving the suction-attachment plate 72 thus.

Other advantageous effects are similar to those of the first exemplary embodiment.

Third Exemplary Embodiment

Explanation follows regarding an image forming apparatus and image forming method of a third exemplary embodiment of the present invention with reference to FIG. 10 to FIG. 13. Similar members to those of the first exemplary embodiment are allocated the same reference numerals and further explanation is omitted.

Figure 10:
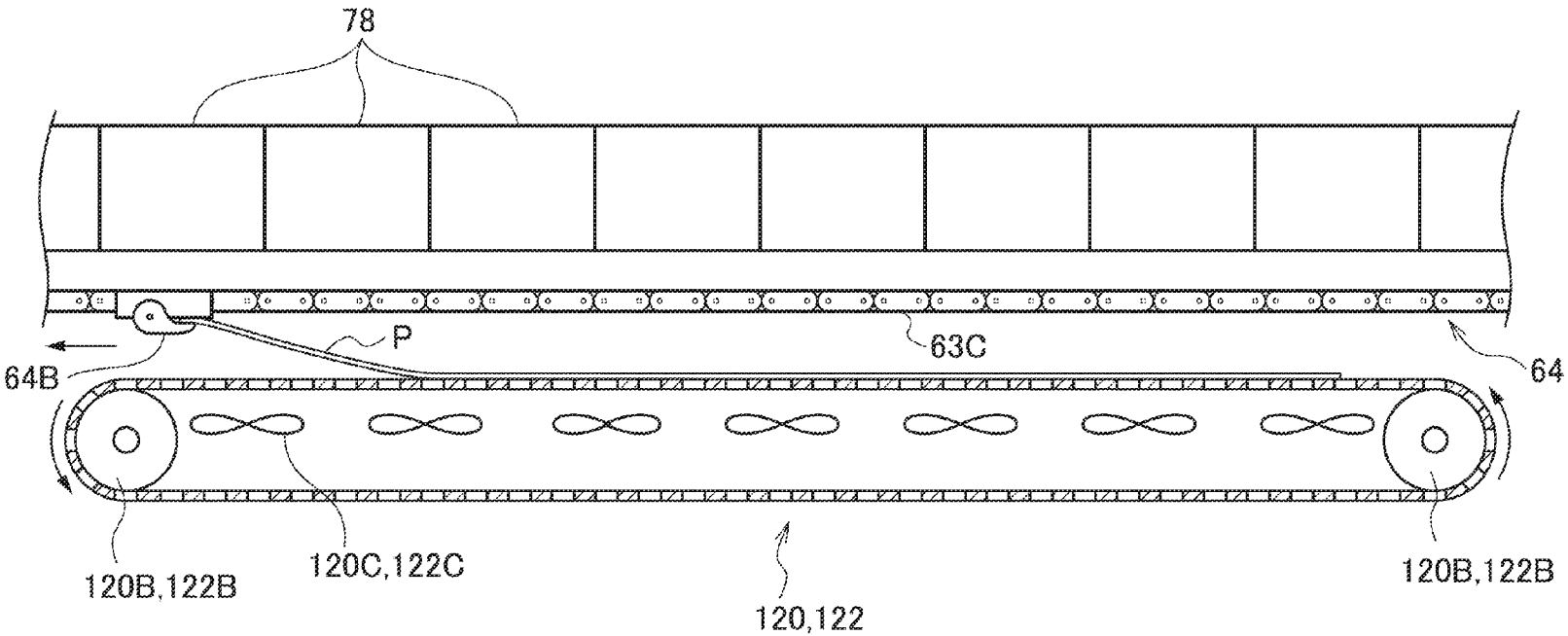
FIG. 10 is a side view illustrating a conveyor belt and a chain gripper employed in an image forming apparatus according to a third exemplary embodiment.
Figure 11:
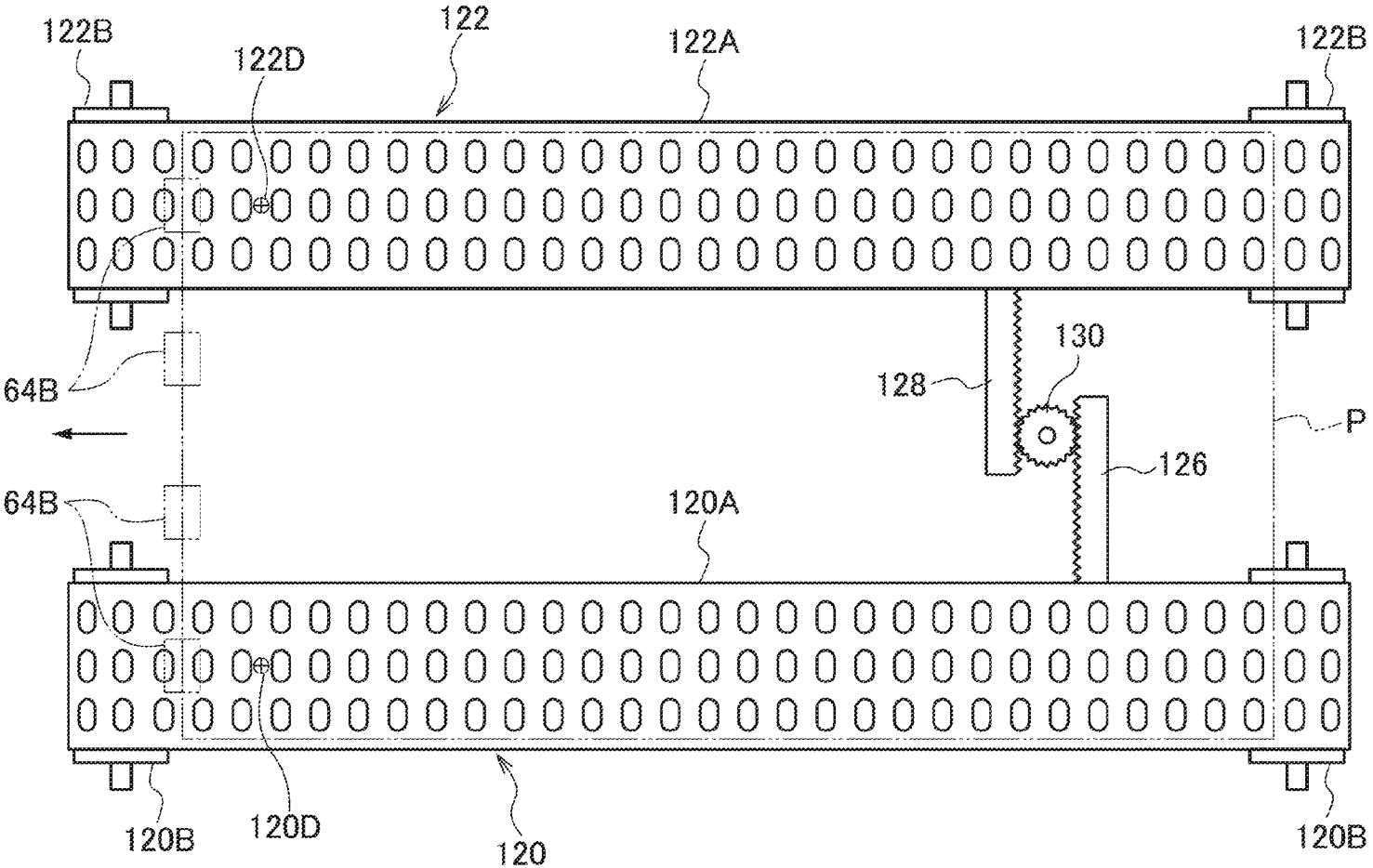
FIG. 11 is a plan view illustrating conveyor belts employed in an image forming apparatus according to the third exemplary embodiment of the present invention.

As shown in FIG. 10 and FIG. 11, in the third exemplary embodiment there is no suction-attachment plate provided, and instead a first conveyor belt 120 and a second conveyor belt 122 are provided for conveying the sheet member P by circulating while suctioning the back face of the sheet member P being conveyed by the chain gripper 64.

Configuration is made such that one width direction edge side of the sheet member P disposed between the first conveyor belt 120 and the second conveyor belt 122 is suction-attached to the first conveyor belt 120, and the other width direction edge of the sheet member P is suctioned onto the second conveyor belt 122.

More specifically, in the first conveyor belt 120 there is an endless belt member 120A formed with plural individual holes in the front face, a pair of rollers 120B around which the belt member 120A is entrained, and plural individual fans 120C provided inside the belt member 120A for generating suction force at a suction-attachment face. A drive source (not shown in the drawings) is also provided for imparting rotational force to the rollers 120B.

Similarly, in the second conveyor belt 122 there is an endless belt member 122A formed with plural individual holes in the front face, a pair of rollers 122B around which the belt member 122A is entrained, and plural individual fans 122C provided inside the belt member 122A for generating suction force at a suction-attachment face. A drive source (not shown in the drawings) is also provided for imparting rotational force to the rollers 122B.

Figure 12:
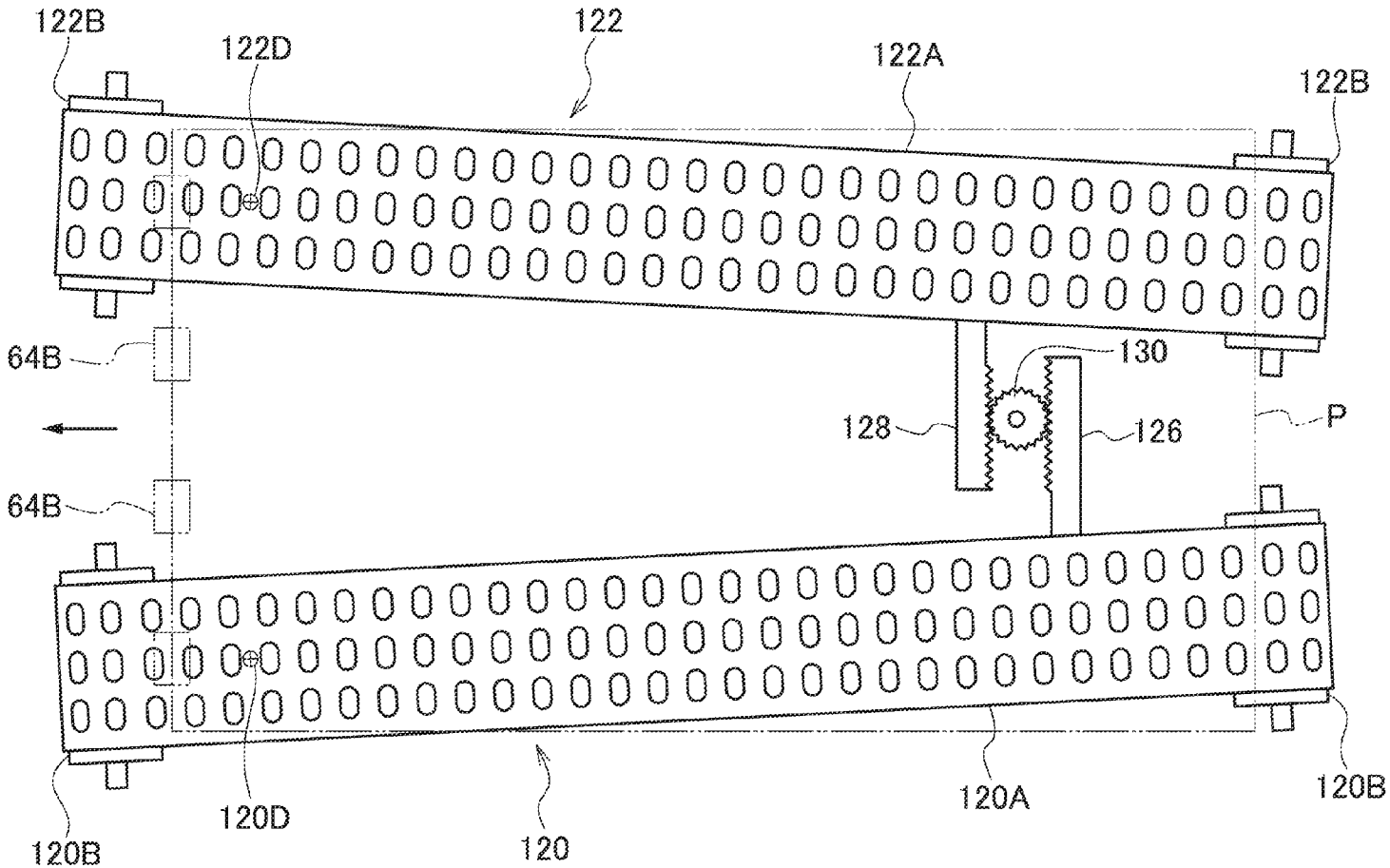
FIG. 12 is a plan view illustrating conveyor belts employed in an image forming apparatus according to the third exemplary embodiment of the present invention.

As shown in FIG. 11 and FIG. 12, shaft portions 120D, 122D are also provided so as to support the first conveyor belt 120 and the second conveyor belt 122 such that they are capable of pivoting in plan view. The first conveyor belt 120 and the second conveyor belt 122 are accordingly configured so as to be able to pivot between a parallel position in which the first conveyor belt 120 and the second conveyor belt 122 are parallel to each other (see FIG. 11), and a separating position in which the first conveyor belt 120 and the second conveyor belt 122 gradually separate from each other on progression towards the conveying direction downstream side (see FIG. 12).

A first rack member 126 is also provided with a base end portion fixed to a frame member (not shown in the drawings) of the first conveyor belt 120 and with a leading end portion extending out towards the second conveyor belt 122. Similarly, a second rack member 128 is also provided with a base end portion fixed to a frame member (not shown in the drawings) of the second conveyor belt 122, and with a leading end portion extending towards the first conveyor belt 120. Gear teeth of the second rack member 128 face towards the gear teeth of the first rack member 126.

A pinion gear 130 is also provided between the first rack member 126 and the second rack member 128 so as to mesh with the gear teeth of the first rack member 126 and the second rack member 128. A stepping motor (not shown in the drawings) is also provided for applying rotation force to the pinion gear 130.

Such a configuration enables the first conveyor belt 120 and the second conveyor belt 122 to be moved between the parallel position and the separating position by rotating the pinion gear 130.

Figure 13:
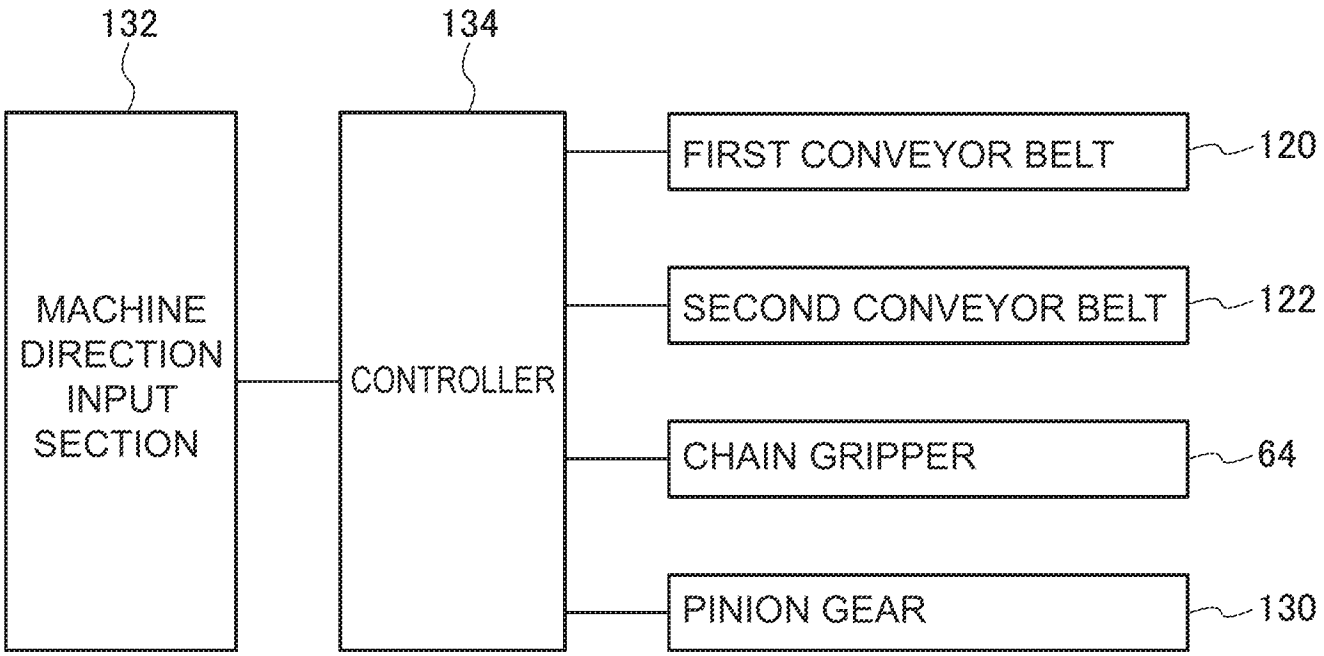
FIG. 13 is a block diagram illustrating a control path of a controller employed in an image forming apparatus according to the third exemplary embodiment of the present invention.

As shown in FIG. 13, a machine direction input section 132 is provided to the image forming apparatus 10 for inputting the machine direction of the sheet member P to be used. A controller 134 is also provided for controlling the conveying speed of the first conveyor belt 120, the conveying speed of the second conveyor belt 122, the conveying speed of the chain gripper 64, and the rotation angle of the pinion gear 130 according to the input result to the machine direction input section 132.

According to the above configuration, as shown in FIG. 12 and FIG. 13, when the machine direction of the sheet member P is input as the sheet member P conveying direction to the machine direction input section 132, the controller 134 controls the rotation angle of the pinion gear 130 so as to dispose the first conveyor belt 120 and the second conveyor belt 122 in the separating position. The controller 134 also controls the conveying speed of the first conveyor belt 120, the conveying speed of the second conveyor belt 122, and the conveying speed of the chain gripper 64 such that the speed the sheet member P is conveyed by the chain gripper 64 and the speed the sheet member P is conveyed by the first conveyor belt 120 and the second conveyor belt 122 are the same speed as each other.

Tension is thereby induced in the sheet member P in a direction orthogonal to the sheet member P conveying direction by disposing the first conveyor belt 120 and the second conveyor belt 122 in the separating position.

However, as shown in FIG. 11 and FIG. 13, when the machine direction of the sheet member P is input to the machine direction input section 132 as a direction orthogonal to the sheet member P conveying direction, the controller 134 controls the rotation angle of the pinion gear 130 so as to dispose the first conveyor belt 120 and the second conveyor belt 122 in the parallel position. The controller 134 controls the conveying speed of the first conveyor belt 120, the conveying speed of the second conveyor belt 122 and the conveying speed of the chain gripper 64, such that the speed the sheet member P is conveyed by the chain gripper 64 is faster than the speed the sheet member P is conveyed by the first conveyor belt 120 and the second conveyor belt 122.

Tension is accordingly induced in the sheet member P in the sheet member P conveying direction due to making the speed the sheet member P is conveyed by the chain gripper 64 faster than the speed the sheet member P is conveyed by the first conveyor belt 120 and the second conveyor belt 122.

As explained above, the controller 134 selects to induce in the sheet member P either tension in the sheet member P conveying direction or tension in the direction orthogonal to the sheet member P conveying direction according to the sheet member P machine direction. More specifically, tension is induced in the present exemplary embodiment in the direction orthogonal to the machine direction. Waviness can thereby be efficiently suppressed from occurring in the sheet member P.

Other advantageous effects are similar to those of the first exemplary embodiment.

Fourth Exemplary Embodiment

Figure 14:
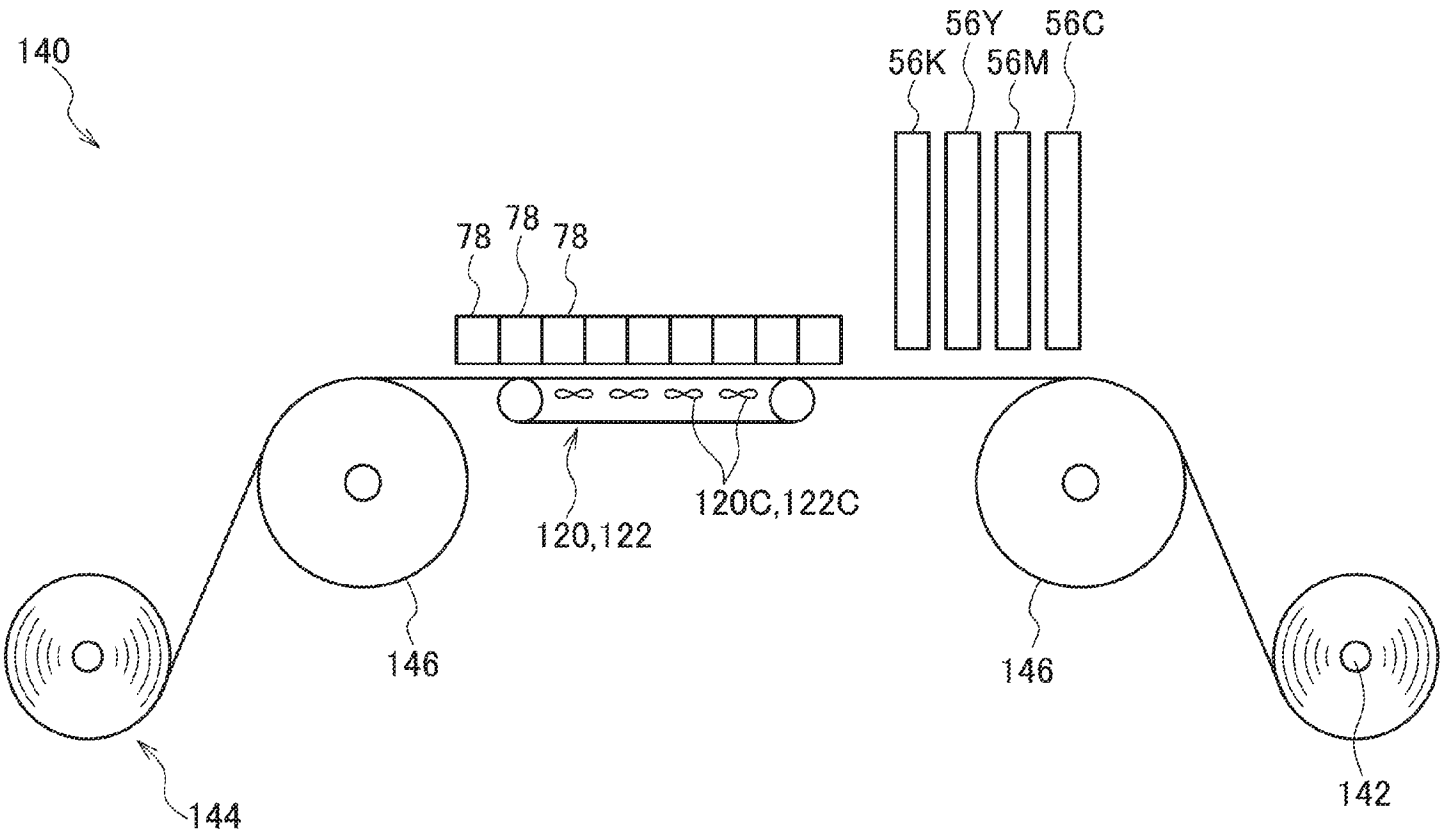
FIG. 14 is a schematic configuration diagram illustrating an image forming apparatus according to a fourth exemplary embodiment of the present invention.
Figure 15:
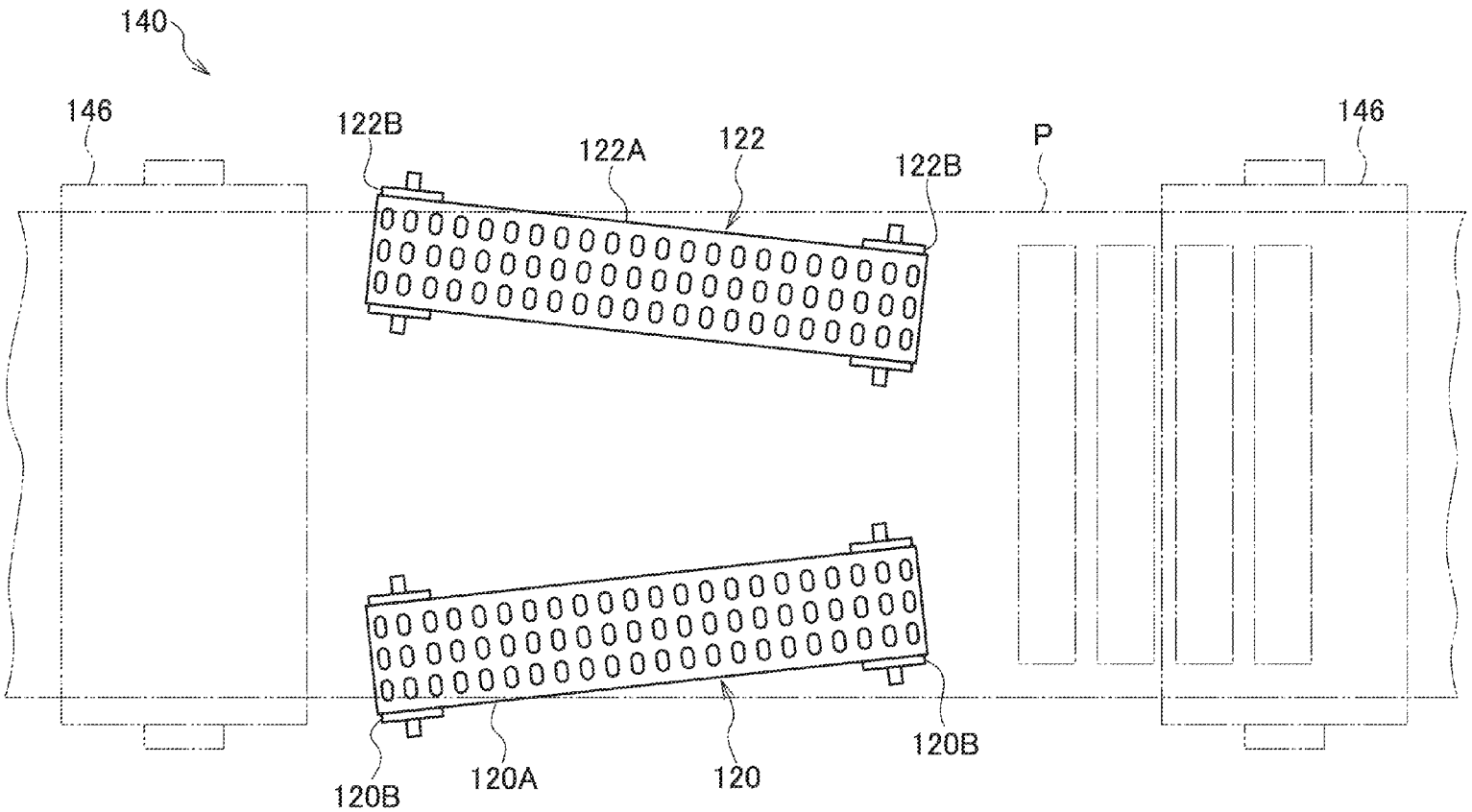
FIG. 15 is a plan view illustrating conveyor belts employed in the fourth exemplary embodiment of the present invention.

Explanation follows regarding an image forming apparatus and image forming method according to a fourth exemplary embodiment of the present invention, with reference to FIG. 14 and FIG. 15. Similar members to those of the third exemplary embodiment are allocated the same reference numerals and further explanation is omitted.

As shown in FIG. 14 and FIG. 15, in the fourth exemplary embodiment the sheet member P onto which liquid droplets are jetted is continuous-paper rather than sheet-paper.

An image forming apparatus 140 is provided with a feed roller 142 for feeding out the continuous-paper sheet member P, and a take-up roller 144 for taking up the sheet member P fed out by the feed roller 142.

A pair of wrap rollers 146 for wrapping the sheet member P around are provided separated from each other and disposed between the feed roller 142 and the take-up roller 144. Recording heads 56 for each color are also provided at the sheet member P conveying direction upstream side between the pair of wrap rollers 146 for jetting liquid droplets onto the front face of the sheet member P.

Plural individual infrared heaters 78 are also provided at the conveying direction downstream side of the recording heads 56 so as to face towards the front face of the sheet member P. A first conveyor belt 120 and a second conveyor belt 122 are also provided in a separating position on the opposite side of the sheet member P to the side of the infrared heaters 78.

The machine direction of the continuous-paper sheet member P is aligned by such a configuration with the sheet member P conveying direction, such that tension is induced in the direction orthogonal to the sheet member P conveying direction.

While the present invention has been explained in detail by means of particular exemplary embodiments the present invention is not limited by these exemplary embodiments. It will be obvious to someone of ordinary skill in the art that various other exemplary embodiments are possible within the scope of the present invention. For example, while not particularly referred to, in the above exemplary embodiments the waviness reduction effect is somewhat reduced when the direction in which tension is induced is not a direction orthogonal to the machine direction, for example when tension is induced in a direction parallel to the machine direction. It is therefore preferable to change the direction for inducing tension according to the machine direction.

What is claimed is:

1. An image forming apparatus comprising:

an image forming member that jets liquid droplets onto a recording medium and forms an image on a front face of the recording medium;

a tension imparting member that induces tension of 100 N/m to 1000 N/m in the recording medium on which the image has been formed by the image forming member, the tension imparting member comprising:

a conveying member that conveys the recording medium, and a suction-attachment plate for suction-attaching a back face of the recording medium being conveyed by the conveying member;

a drying member that dries the image formed on the front face of the recording medium, when tension is induced in the recording medium by the tension imparting member, to a residual moisture level of 3 $g/m^2$ or less in the recording medium; and a moving member that moves the suction-attachment plate towards a recording medium conveying direction downstream side while the recording medium being conveyed by the conveying member is in a suction-attached state, wherein tension is induced in the recording medium by a movement speed of the suction-attachment plate due to the moving member being slower than a movement speed of the recording medium due to the conveying member.

2. The image forming apparatus of claim 1, wherein the tension imparting member induces tension along a recording medium conveying direction.

3. The image forming apparatus of claim 2, wherein:

the conveying member of the tension imparting member retains, with a retaining member, a leading end portion of the recording medium on which the image has been formed by the image forming member; and the suction-attachment plate suction-attaches the back face of the recording medium being conveyed by the conveying member while the leading end portion of the recording medium is retained by the retaining member.

4. The image forming apparatus of claim 1, wherein the tension imparting member induces tension in the recording medium in a direction orthogonal to a recording medium conveying direction.

5. The image forming apparatus of claim 4, wherein the tension imparting member comprises:

a first conveyor belt that circulates with the back face of the recording medium suction-attached to the first conveyor belt so as to convey the recording medium; and a second conveyor belt disposed alongside the first conveyor belt, circulating with the back face of the recording medium suction-attached to the second conveyor belt so as to convey the recording medium, and disposed so as to be separated further from the first conveyor belt at the recording medium conveying direction downstream side than at the conveying direction upstream side.

6. The image forming apparatus of claim 1, further comprising a controller that controls the tension imparting member based on the direction of a machine direction of the recording medium so as to select to induce tension in the recording medium in a recording medium conveying direction or to induce tension in the recording medium in a direction orthogonal to the recording medium conveying direction.

7. The image forming apparatus of claim 1, wherein the recording medium is sheet-paper, and the tension imparting member induces tension in the sheet-paper.

8. The image forming apparatus of claim 1 wherein the recording medium is continuous-paper, and the tension imparting member induces tension in the continuous-paper.

9. The image forming apparatus of claim 1, further comprising a process liquid coating member provided at a recording medium conveying direction upstream side of the image forming member to coat the recording medium with a process liquid that aggregates colorant present in the liquid droplets jetted from the image forming member.

10. The image forming apparatus of claim 9, further comprising a process liquid drying member that dries the process liquid that has been coated on the recording medium by the process liquid coating member.

11. An image forming method comprising:

an image forming process of jetting liquid droplets onto a recording medium and forming an image on a front face of the recording medium;

a tension imparting process of:

conveying the recording medium via a conveying member, by retaining, with a retaining member, a leading end portion of the recording medium on which the image has been formed by the image forming member, suction-attaching, by a suction-attachment plate, a back face of the recording medium being conveyed by the conveying member while the leading end portion of the recording medium is retained by the retaining member, and moving, by a moving member, the suction-attachment plate towards a recording medium conveying direction downstream side while the recording medium being conveyed by the conveying member is in a suction-attached state, wherein a movement speed of the suction-attachment plate due to the moving member is configured to be slower than a movement speed of the recording medium due to the conveying member, such that tension of 100 N/m to 1000 N/m is induced in the recording medium along a recording medium conveying direction; and a liquid droplet drying process of drying the image formed on the front face of the recording medium induced with tension of 100 N/m to 1000 N/m to a residual moisture level of 3 $g/m^2$ or less in the recording medium when the tension is induced in the recording medium.

12. The image forming method of claim 11, further comprising a process liquid coating process provided prior to the image forming process for coating the recording medium with a process liquid that aggregates colorant present in the liquid droplets jetted onto the recording medium in the image forming process.

13. The image forming method of claim 12, further comprising a process liquid drying process that dries the process liquid coated onto the recording medium in the process liquid coating process.

* * * * *